US012337438B2

(12) United States Patent
Nabeya et al.

(10) Patent No.: US 12,337,438 B2
(45) Date of Patent: Jun. 24, 2025

(54) BREAK-IN PROCESSING APPARATUS AND BREAK-IN PROCESSING METHOD

(71) Applicant: EBARA CORPORATION, Tokyo (JP)

(72) Inventors: Osamu Nabeya, Tokyo (JP); Kenichi Akazawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 398 days.

(21) Appl. No.: 17/812,738

(22) Filed: Jul. 15, 2022

(65) Prior Publication Data

US 2023/0026543 A1 Jan. 26, 2023

(30) Foreign Application Priority Data

Jul. 21, 2021 (JP) ..... 2021-120861

(51) Int. Cl.
*B24B 37/005* (2012.01)
*B24B 49/16* (2006.01)
*B24B 57/02* (2006.01)

(52) U.S. Cl.
CPC ..... *B24B 37/005* (2013.01); *B24B 49/16* (2013.01); *B24B 57/02* (2013.01)

(58) Field of Classification Search
CPC ..... B24B 49/16; B24B 37/005; B24B 37/30; B24B 37/042; B24B 37/047; B24B 37/0053
See application file for complete search history.

(56) References Cited

U.S. PATENT DOCUMENTS 6,143,123 A * 11/2000 Robinson ..... B24B 37/013 156/934
6,435,956 B1 * 8/2002 Ohwada ..... B24B 49/10 451/41
6,712,670 B2 * 3/2004 de la Llera ..... B24B 37/30 451/24

(Continued)

FOREIGN PATENT DOCUMENTS

JP 2002-134446 A 5/2002
JP 2003-142438 A 5/2003

(Continued)

*Primary Examiner* — C. A. Rivera
(74) *Attorney, Agent, or Firm* — Chrisman Gallo Tochtrop LLC

(57) ABSTRACT

A break-in processing apparatus is disclosed, which can reliably perform a break-in process for an elastic membrane without reducing a utilization rate of a polishing apparatus. The break-in processing apparatus includes a stage to which an elastic membrane assembly including a carrier and an elastic membrane attached to the carrier is placed; a break-in determination module facing the elastic membrane placed to the stage; a fluid supply unit configured to supply a pressurized fluid into a pressure chamber formed between the outermost periphery portion of the elastic membrane and the carrier; and a controller configured to control operations of the break-in determination module and the fluid supply unit. The controller determines a completion of a break-in process of the elastic membrane based on a load applied to the break-in determination module by the elastic membrane which is expanded by the pressurized fluid supplied into the pressure chamber.

10 Claims, 16 Drawing Sheets

(56) References Cited

U.S. PATENT DOCUMENTS

| | | | | |
|---|---|---|---|---|
| 6,754,942 | B2 | 6/2004 | Choi et al. | |
| 7,089,782 | B2 | 8/2006 | Lin et al. | |
| 2015/0273650 | A1* | 10/2015 | Namiki | B24B 37/015 451/5 |

FOREIGN PATENT DOCUMENTS

| | | | | | |
|---|---|---|---|---|---|
| JP | 2003273047 | A | * | 9/2003 | |
| JP | 2019-077028 | A | | 5/2019 | |
| KR | 10-2021-0066147 | A | | 6/2021 | |
| WO | WO-2018179685 | A1 | * | 10/2018 | B23Q 15/16 |

* cited by examiner

BREAK-IN PROCESSING APPARATUS AND BREAK-IN PROCESSING METHOD

CROSS REFERENCE TO RELATED APPLICATION

This document claims priority to Japanese Patent Application No. 2021-120861 filed Jul. 21, 2021, the entire contents of which are hereby incorporated by reference.

BACKGROUND

A polishing apparatus for performing CMP (Chemical Mechanical Polishing) has a substrate holding apparatus, which is called a top ring or a polishing head, for holding a substrate, such as a wafer, and pressing this substrate against a polishing surface of the polishing pad held by a polishing table at a predetermined pressure. At this time, the polishing table and the substrate holding apparatus are moved relative to each other to bring the substrate into sliding contact with the polishing surface, thereby polishing a surface of the substrate.

During polishing of the wafer, if a relative pressing force applied between the substrate and the polishing surface of the polishing pad is not uniform over the entire surface of the substrate, insufficient polishing or excessive polishing would occur depending on a pressing force applied to each portion of the substrate. Thus, in order to make the pressing force against the substrate uniform, the substrate holding apparatus has a pressure chamber defined by an elastic membrane at a lower part thereof. This pressure chamber is supplied with a fluid, such as air, to press the substrate through the elastic membrane with a fluid pressure.

As the polishing process of the substrate is repeated in the polishing apparatus, the elastic membrane becomes degraded. The degraded elastic membrane needs to be replaced with a new elastic membrane. Since the replaced new elastic membrane does not have sufficient elasticity (flexibility), the substrate cannot be pressed against the polishing surface of the polishing pad with a desired pressing force even if a fluid having the predetermined pressure is supplied to the pressure chamber. Therefore, a fluid (e.g., air) having a predetermined pressure is supplied to the pressure chamber of the elastic membrane, and the pressure chamber is left in this state for a predetermined time, and then opened to the atmosphere, thereby enhancing the elasticity of the new elastic membrane that has been replaced (see, for example, Japanese laid-open patent publication No. 2019-77028). In this specification, the expansion and contraction process (also called stretching process) of the elastic membrane immediately after the replacement of the elastic membrane is referred to as a "break-in process".

However, the conventional break-in process is performed with a new elastic membrane attached to the substrate holding apparatus of the polishing apparatus. In this case, the polishing apparatus cannot be operated during performing of the break-in process, resulting in a lower utilization rate of the polishing apparatus.

Further, a confirmation of whether or not the break-in process has been properly performed is made from a polishing profile of the monitor wafer that has been polished using the new elastic membrane. When the break-in process is insufficient, the break-in process is required to be performed again, so that the utilization of the polishing apparatus is further reduced.

SUMMARY

Therefore, there are provided a break-in processing apparatus and a break-in processing method capable of reliably performing a break-in process for an elastic membrane without reducing a utilization rate of a polishing apparatus.

Embodiments, which will be described below, relate to an apparatus and a method of performing a break-in process for an elastic membrane which is used in a substrate holding apparatus for holding a substrate, such as a wafer.

In an embodiment, there is provided a break-in processing apparatus comprising: a stage to which an elastic membrane assembly including at least a carrier and an elastic membrane attached to the carrier is placed; a break-in determination module facing an outermost periphery portion of the elastic membrane of the elastic membrane assembly placed to the stage; a fluid supply unit configured to supply a pressurized fluid having a predetermined pressure into a pressure chamber formed between the outermost periphery portion of the elastic membrane and the carrier; and a controller configured to control operations of the break-in determination module and the fluid supply unit, wherein the controller determines a completion of a break-in process of the elastic membrane based on a load applied to the break-in determination module by the elastic membrane which is expanded by the pressurized fluid supplied into the pressure chamber.

In an embodiment, the break-in determination module includes: a load distributing ring facing the outermost periphery portion of the elastic membrane; and a load cell configured to measure the load applied from the elastic membrane through the load distributing ring.

In an embodiment, the break-in determination module includes a pressure-sensitive sensor configured to measure a distribution of the load applied from the elastic membrane in the radial direction of the elastic membrane.

In an embodiment, the break-in determination module further includes a shape measuring device which can measure a shape of a lower surface of the outermost periphery portion of the elastic membrane opened to atmosphere, and the controller confirms the completion of the break-in process of the elastic membrane based not only on the load applied to the break-in determination module, but also on the shape of the lower surface of the outermost periphery portion of the elastic membrane measured by the shape measuring device.

In an embodiment, the shape measuring device is a two-dimensional displacement sensor that emits a laser beam to the lower surface of the outermost periphery portion of the elastic membrane to thereby obtain the shape of the lower surface of the outermost periphery portion of the elastic membrane.

In an embodiment, the fluid supply unit includes: a fluid supply line communicating with a pressure chamber formed between the elastic membrane and the carrier; and a flow meter and/or a pressure gauge disposed in the fluid supply line, and the controller supplies the pressurized fluid having a predetermined pressure into the pressure chamber; measures a flow rate and/or a pressure of the pressurized fluid; and determines whether or not to generate a leak-detection signal based on measurement values of the flow rate and/or the pressure of the pressurized fluid.

In an embodiment, the controller measures, during supplying of the pressurized fluid into the pressure chamber, the flow rate of the pressurized fluid while regulating the pressure of the pressurized fluid in the pressure chamber by use of a pressure regulator; measures the pressure of the pressurized fluid in the pressure chamber; determines whether or not measurement value of the flow rate of the pressurized fluid, which has been measured when variation of the pressure of the pressurized fluid is within an allowable range, is within a reference range; and generates the leak-detection signal when the flow rate is outside of the reference range.

In an embodiment, there is provided a break-in processing method for an elastic membrane attached to a carrier, comprising: placing an elastic membrane assembly including at least the carrier and the elastic membrane; supplying a pressurized fluid having a predetermined pressure into a pressure chamber formed between an outermost periphery portion of the elastic membrane and the carrier; and determining a completion of a break-in process of the elastic membrane based on a load applied to a break-in determination module which faces the outermost periphery portion of the elastic membrane of the elastic membrane assembly placed to the stage.

In an embodiment, determining the completion of the break-in process of the elastic membrane is determined based on a measurement result of a load cell which measures the load applied from the elastic membrane through a load distribution ring facing the outermost periphery portion of the elastic membrane.

In an embodiment, determining the completion of the break-in process of the elastic membrane is determined based on a measurement result of a pressure-sensitive sensor which measures a distribution of the load applied from the elastic membrane in the radial direction of the elastic membrane.

In an embodiment, the break-in processing method further comprises: opening the pressure chamber to atmosphere; measuring a shape of a lower surface of the outermost periphery portion of the elastic membrane; and confirming the completion of the break-in process of the elastic membrane based on the shape of the lower surface of the outermost periphery portion of the elastic membrane.

In an embodiment, measuring the shape of the lower surface of the outermost periphery portion of the elastic membrane is performed by use of a two-dimensional displacement sensor which emits a laser beam to the lower surface of the outermost periphery portion of the elastic membrane to thereby obtain the shape of the lower surface of the outermost periphery portion of the elastic membrane.

In an embodiment, the break-in processing method further comprises: performing a leak checking of the elastic membrane before the break-in process, wherein the leak checking includes: supplying a pressurized fluid into a pressure chamber formed between the elastic membrane and the carrier in a state where the elastic membrane is placed in close contact with the stage; measuring a flow rate and/or a pressure of the pressurized fluid; and determining whether or not to generate a leak-detection signal based on the flow rate and/or the pressure of the pressurized fluid.

In an embodiment, the leak checking includes: measuring, during supplying of the pressurized fluid into the pressure chamber, the flow rate of the pressurized fluid while regulating the pressure of the pressurized fluid in the pressure chamber by use of a pressure regulator; measuring the pressure of the pressurized fluid in the pressure chamber; determining whether or not measurement value of the flow rate of the pressurized fluid, which has been measured when variation of the pressure of the pressurized fluid is within an allowable range, is within a reference range; and generating the leak-detection signal when the flow rate is outside of the reference range.

The break-in process for the elastic membrane can be reliably completed before the elastic membrane assembly is installed in the polishing apparatus. Therefore, after the elastic membrane assembly is installed in the polishing apparatus, there is no need to perform the break-in process for the elastic membrane, and further there is no need to confirm that the elastic membrane has acquired sufficient elasticity. As a result, a reduction in the utilization rate of the polishing apparatus can be prevented.

DESCRIPTION OF EMBODIMENTS

Figure 1:
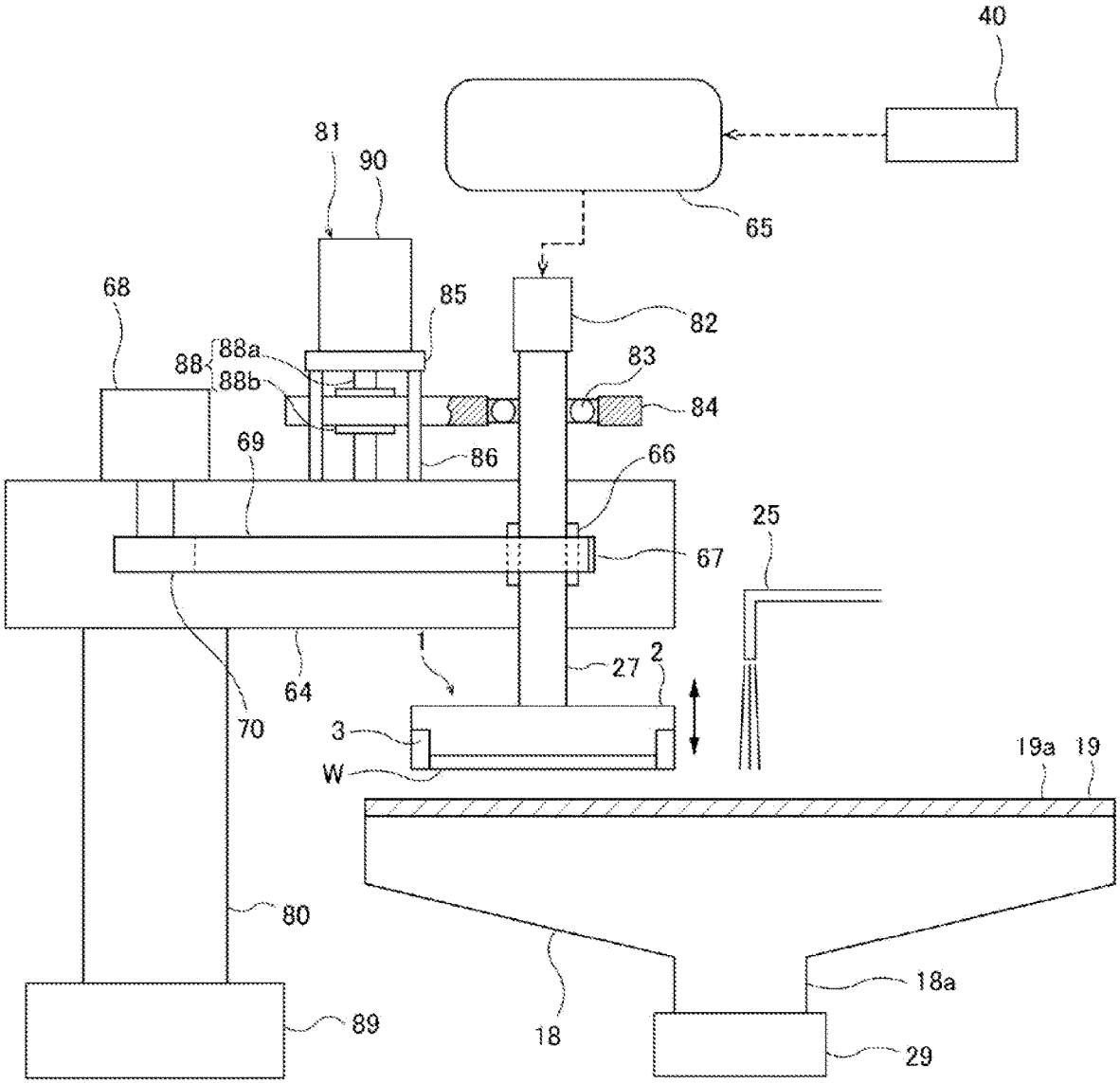
FIG. 1 is a view showing an example of a polishing apparatus.

Embodiments will be described below with reference to the drawings. FIG. 1 is a view showing an example of a polishing apparatus. As shown in FIG. 1, the polishing apparatus includes a polishing table 18 for supporting a polishing pad 19, and a polishing head (substrate holding apparatus) 1 for holding a wafer W as an example of a substrate, and pressing the wafer W against the polishing pad 19 on the polishing table 18. In the polishing apparatus as shown in FIG. 1, an elastic membrane, where the break-in process described below is performed, is attached to the polishing head 1.

The polishing table 18 is coupled via a table shaft 18*a* to a table motor 29 disposed below the polishing table 18, so that the polishing table 18 is rotatable about the table shaft 18*a* The polishing pad 19 is attached to an upper surface of the polishing table 18. A surface 19*a* of the polishing pad 19 serves as a polishing surface for polishing the wafer W. The polishing pad 19 is supported by the polishing table 18.

A processing-liquid supply nozzle 25 is provided above the polishing table 18 so that the processing liquid supply nozzle 25 supplies a processing liquid comprising a polishing liquid or a cleaning liquid (e.g., pure water) or other liquid onto the polishing pad 19 on the polishing table 18.

The polishing head 1 includes a head body 2 for pressing the wafer W against the polishing surface 19*a*, and a retainer ring 3 for retaining the wafer W therein so as to prevent the wafer W from slipping out of the polishing head 1. The polishing head 1 is coupled to a head shaft 27, which is vertically movable relative to a head arm 64 by a vertically moving device 81. This vertical movement of the head shaft 27 causes the entirety of the polishing head 1 to move vertically relative to the head arm 64 and enables positioning of the polishing head 1. A rotary joint 82 is mounted to an upper end of the head shaft 27.

The vertically moving device 81 for elevating and lowering the head shaft 27 and the polishing head 1 includes a bridge 84 that rotatably supports the head shaft 27 through a bearing 83, a ball screw SS mounted to the bridge 84, a support pedestal 85 supported by support posts 86, and a servomotor 90 mounted to the support pedestal 85. The support pedestal 85, which supports the servomotor 90, is fixedly mounted to the head arm 64 through the support posts 86.

The ball screw 88 includes a screw shaft 88*a* coupled to the servomotor 90 and a nut 88*b* that engages with the screw shaft. 88*a* The head shaft 27 is vertically movable together with the bridge 84. When the servomotor 90 inset in motion, the bridge 84 moves vertically through the ball screw 88, so that the head shaft 27 and the polishing head 1 move vertically.

The head shaft 27 is coupled to a rotary sleeve 66 by a key (not shown). A timing pulley 67 is secured to an outer circumferential portion of the rotary sleeve 66. A head motor 68 is fixed to the head arm 64. The timing pulley 67 is coupled through a timing belt 69 to a timing pulley 70, which is mounted to the head motor 68. When the head motor 68 is set in motion, the rotary sleeve 66 and the head shaft 27 are rotated integrally through the timing pulley 70, the timing belt 69, and the timing pulley 67, thus rotating the polishing head 1. The head arm 64 is supported by an arm shaft 80, which is rotatably supported by a frame (hot shown). The polishing apparatus includes a controller 40 for controlling respective devices provided in the apparatus including the head motor 68, the servomotor 90 and the vertically moving device 81.

The polishing head 1 is configured to be able to hold the wafer W on its lower surface. The head arm 64 is coupled through an arm shaft 80 to an arm motor 89 disposed below the head arm 64, and the head arm 64 is rotatable about the arm shaft 80. The controller 40 is electronically connected to the arm motor 89 and is configured to control the arm motor 89 serving as a swing device for swinging the polishing head 1.

The head arm 64 is configured to be swingable about the arm shaft 80. Thus, the polishing head 1, which holds the wafer W on its lower surface, is moved from a position at which the polishing head 1 receives the wafer W (standby position) to a position above the polishing pad 19 by a swing motion of the head arm 64.

The wafer W is polished in the following manner. The polishing head 1 and the polishing table 18 are rotated, respectively, and the polishing liquid is supplied onto the polishing pad 19 from the processing-liquid supply nozzle 25 provided above the polishing table 18. In this state, the polishing head 1 is lowered to a predetermined position. (predetermined height), and the wafer W is pressed against the polishing surface 19*a* of the polishing pad 19 at the predetermined position. The wafer W is brought into sliding contact with the polishing surface 19*a* of the polishing pad 19, and thus the surface of the wafer W is polished.

Figure 2:
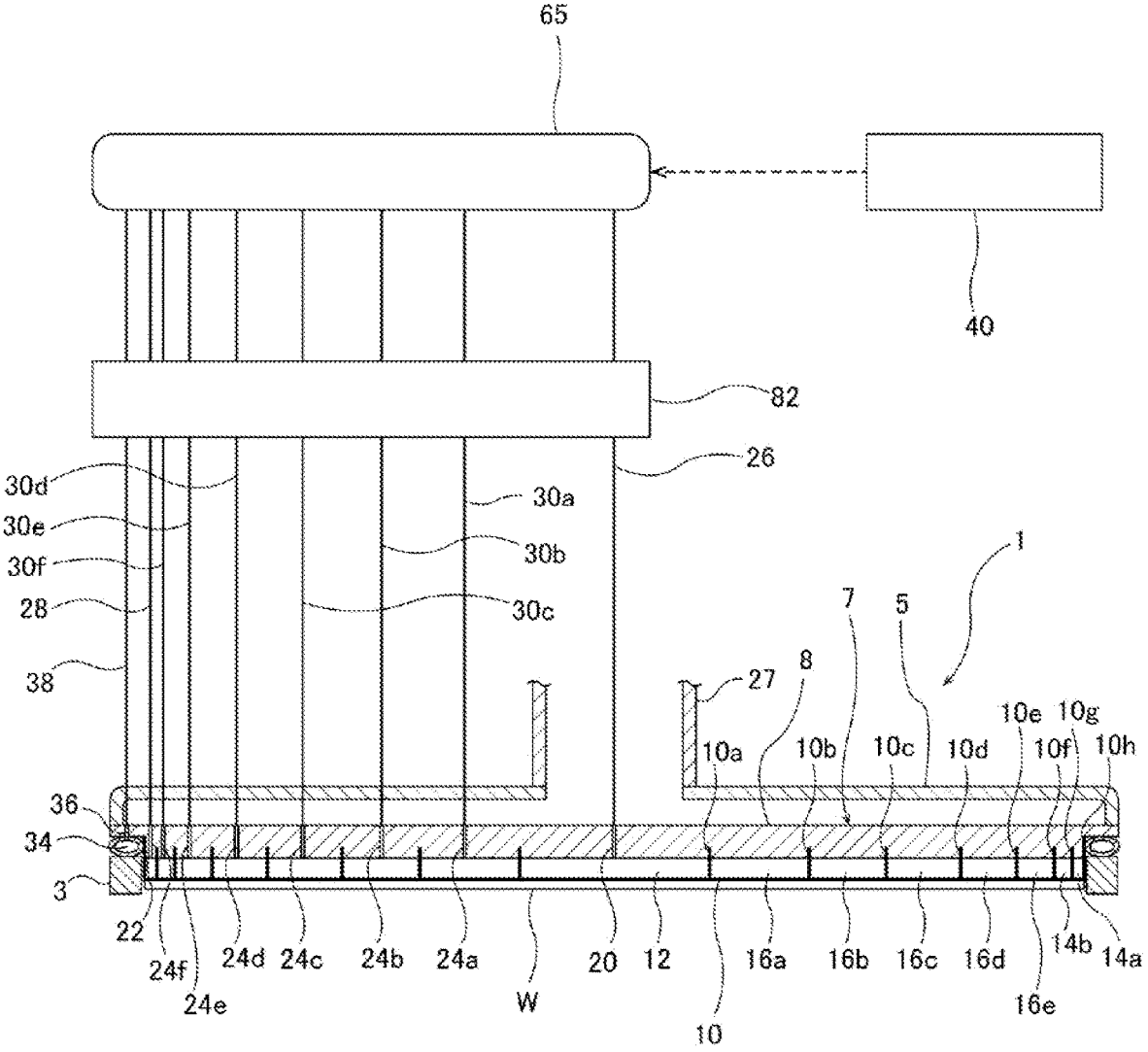
FIG. 2 is a cross-sectional view schematically showing a polishing head.

Next, the polishing head (substrate holding apparatus) 1, which is installed in the polishing apparatus shown in FIG. 1, will be described in detail with reference to FIG. 2. FIG. 2 is a cross-sectional view schematically showing the polishing head 1. As shown FIG. 2, the polishing head 1 includes a head base 5 which is secured to a lower end of the head shaft 27, and an elastic membrane assembly 7 which is attached to a lower end of the head base 5. The elastic membrane assembly 7 is attached to the head base 5 through a coupling mechanism which is not shown in the drawings.

The elastic membrane assembly 7 is basically comprised of the retainer ring 3 for directly pressing the polishing surface 19*a*, an elastic membrane (membrane) 10 for pressing the wafer W against the polishing surface 19*a*, and a carrier 8 to which the elastic membrane 10 is attached. The retainer ring 3 is disposed so as to surround the war W and the elastic membrane 10, and is coupled to the carrier 8. The elastic membrane 10 is attached to the carrier 8 so as to cover a lower surface of the carrier 8.

The elastic membrane 10 has a plurality of (eight in the drawing) annular circumferential walls 10*a*, 10*b*, 10*c*-10*d*-10*e*, 10*f*, 10*g* and 10*h* which are arranged concentrically. The circumferential wall 10*h* corresponds to a side wall located at the outermost peripheral portion of the elastic membrane 10. These circumferential walls 10*a*, 10*b*, 10*c*, 10*d*, 10*e*, 10*f*, 10*g* and 10*h* form a circular central pressure chamber 12 located at a center of the elastic membrane 10, annular edge pressure chambers 14*a*, 14*b* located at the outermost part of the elastic membrane 10, and five (in this embodiment) annular intermediate pressure chambers (i.e., first to fifth intermediate pressure chambers) 16*a*, 16*b*, 16*c*, 16*d* and 16*e* located between the central pressure chamber 12 and the edge pressure chambers 14*a*, 14*b*. In this embodiment, the number of pressure chambers formed by the elastic membrane 10 is eight, but the number of pressure chambers is not limited to this embodiment. The number of pressure chambers may be increased or decreased according to the configuration of the elastic membrane 10.

The carrier 8 has a fluid passage 20 communicating with the central pressure chamber 12, a fluid passage 22 communicating with the edge pressure chamber 14*a*, a fluid passage 24*f* communicating with the edge pressure chamber 14*b*, and fluid passages 24*a*, 24*b*, 24*c*, 24*d* and 24*e* communicating with the intermediate pressure chambers 16*a*, 16*b*, 16*c*, 16*d* and 16*e*, respectively. These fluid passages 20, 22, 24*a*, 24*b*, 24*c*, 24*d*, 24*e* and 24*f* are connected to fluid lines 26, 28, 30*a*, 30*b*, 30*c*, 30*d*, 30*e* and 30*f*, respectively, all of which are connected through the rotary joint 82 to a pressure regulating device 65. The pressure regulating device 65 is electrically connected to the controller 40, and thus the controller 40 can control operation of the pressure regulating device 65.

A retainer chamber 34 is formed immediately above the retainer ring 3. This retainer chamber 34 is connected via a fluid passage 36 formed in the carrier 8 and a fluid line 38 to the pressure regulating device 65.

According to the polishing head 1 configured as shown in FIG. 2, pressures of the pressurized fluid supplied to the respective pressure chambers 12, 14*a*, 14*b*, 16*a*, 16*b*, 16*c*, 16*d* and 16*e* are controlled, respectively, in a state where the wafer W is held by the polishing head 1, so that the polishing head 1 can press the wafer W with different pressures that are transmitted through multiple areas of the elastic membrane 10 arrayed along a radial direction of the wafer W. Thus, in the polishing head 1, pressing forces applied to the wafer W can be adjusted at multiple zones of the wafer W by adjusting pressures of the pressurized fluid supplied to the respective pressure chambers 12, 14*a*, 14*b*, 16*a*, 16*b*, 16*c*, 16*d* and 16*e* formed between the carrier 8 and the elastic membrane 10. At the same time, by controlling the pressure of the pressure fluid supplied to the retainer chamber 34, the pressing force of the retainer ring 3 pressing the polishing pad 19 can be regulated.

The carrier S is made of resin such as engineering plastic (e.g., PEEK), and the elastic membrane 10 is made of a highly strong and durable rubber material such as ethylene propylene rubber (EPDM), polyurethane rubber, silicone rubber, or the like.

In the case where the elastic membrane 10 is replaced as occasion arises, such as maintenance, a newly replaced elastic membrane 10 does not have sufficient elasticity (flexibility). Therefore, when the fluid having a predetermined pressure is supplied to each of the pressure chambers 12, 14*a*, 14*h*, and 16*a* to 16*e*, the wafer W cannot be pressed against the polishing surface 19*a* of the polishing pad 19 with a desired pressing force. Thus, it is necessary to perform a break-in process that the pressurized fluid is supplied to each of the pressure chambers 12, 14*a*, 14*b*, 16*a*-16*e* of the elastic membrane 10, and to open these pressure chambers to the atmosphere to thereby enhance the elasticity of the elastic membrane 10. Performing the break-in process enables the elasticity (flexibility) of the elastic membrane 10 to be enhanced, so that the wafer W can be pressed against the polishing surface 19*a* of the polishing pad 19 with a desired pressing force. As a result, the surface of the wafer W can be stably polished.

Figure 3:
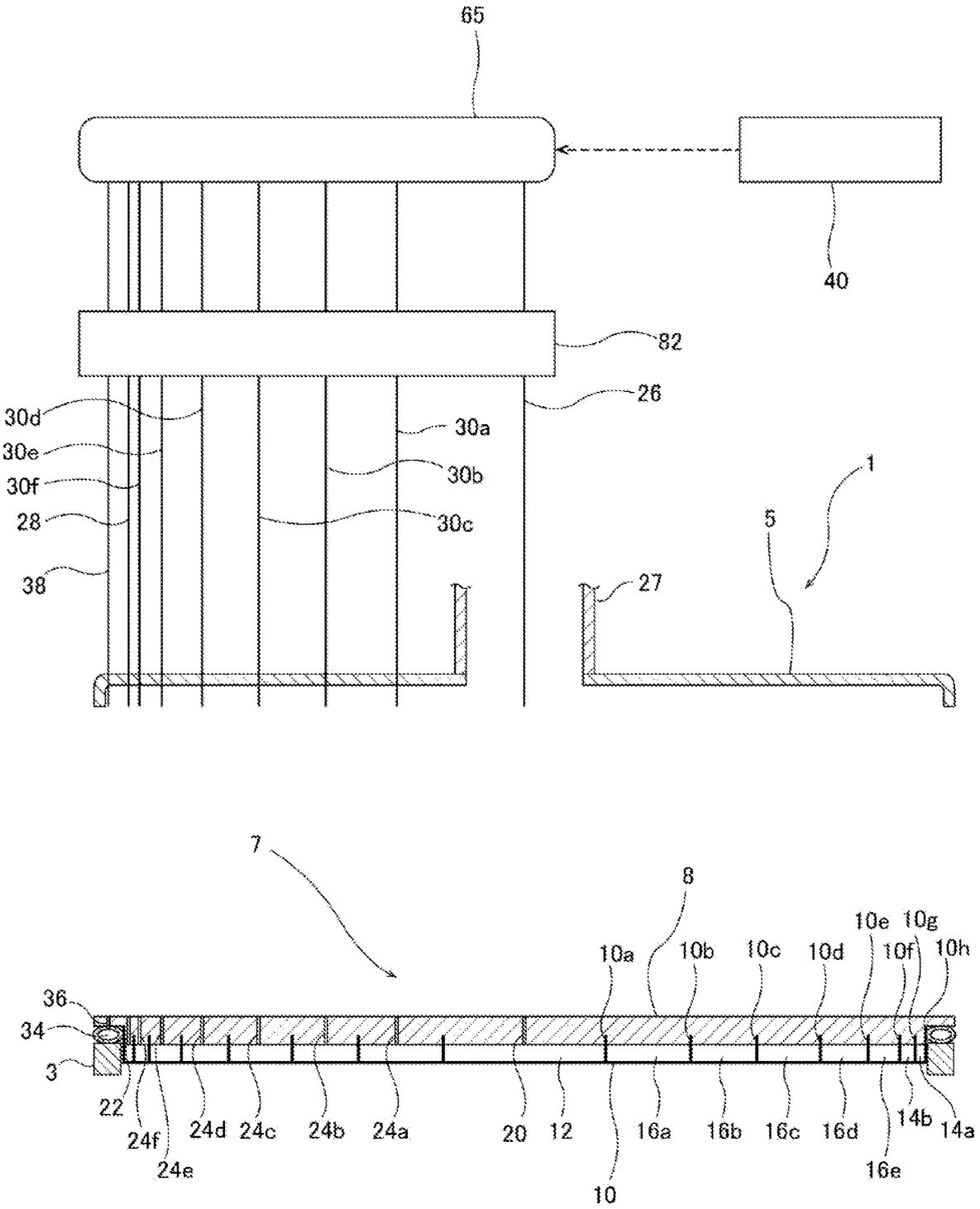
FIG. 3 is a schematic view showing a state in which an elastic membrane assembly is removed from the polishing head shown in FIG. 2.

When the elastic membrane 10 is replaced, i.e., the break-in process is performed, the elastic membrane assembly 7 is removed from the polishing head 1. FIG. 3 is a schematic view showing a state in which the elastic membrane assembly 7 is removed from the polishing head 1 shown in FIG. 2. Next, the elastic membrane 10 is removed from the carrier 8 of the removed elastic membrane assembly 7, and a new elastic membrane 10 is attached to the carrier S of the elastic membrane assembly 7.

Next, the elastic membrane assembly 7 to which the new elastic membrane 10 is attached is installed in a break-in processing apparatus, which will be described below, performing, the break-in process for the new elastic membrane 10.

Figure 4:
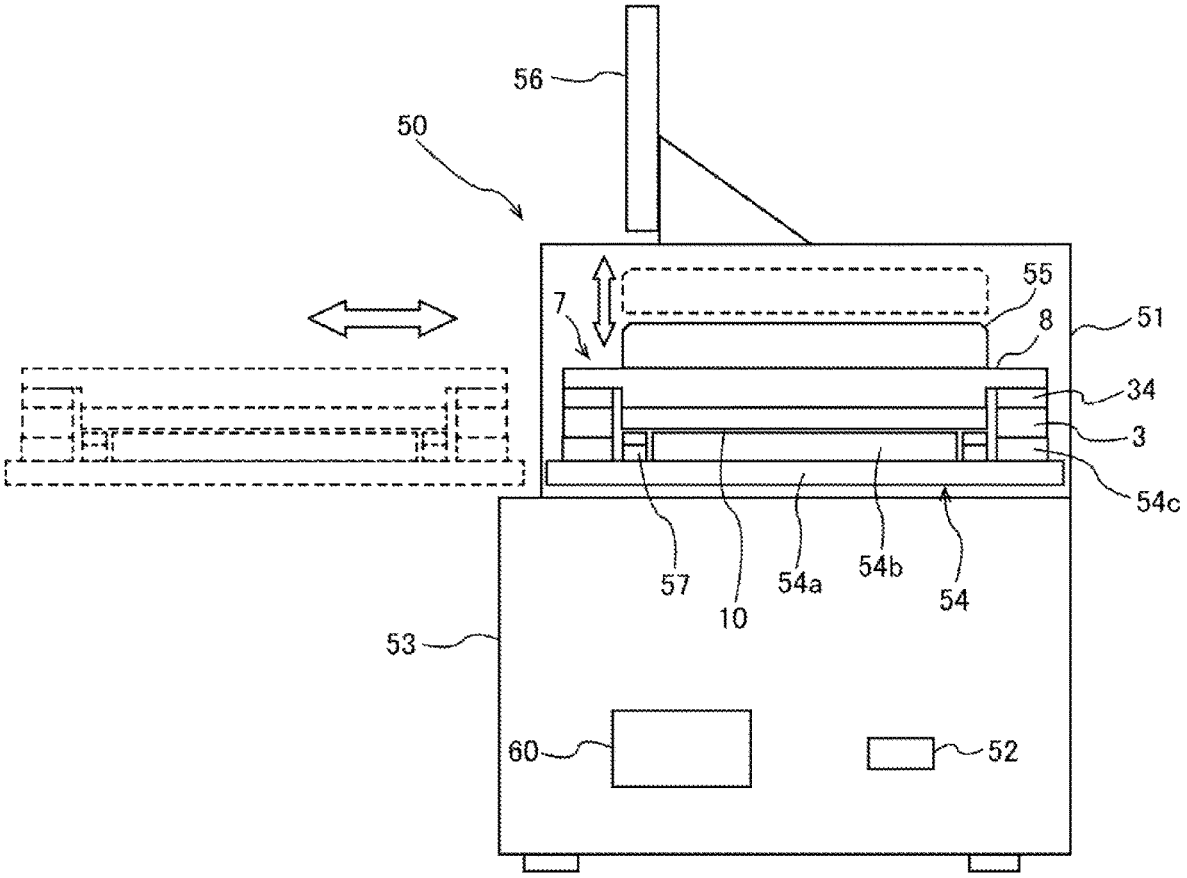
FIG. 4 is a side view showing a break-in processing apparatus according to an embodiment.

FIG. 4 is a side view showing a break-in processing apparatus according to an embodiment. The break-in processing apparatus 50 shown in FIG. 4 includes a stage 54 on which the elastic membrane assembly 7 is placed, a fluid supply unit 60 for supplying pressurized fluid (e.g., compressed air) to the elastic membrane 10 of the elastic membrane assembly 7 placed on the stage 54, a break-in determination module 57 for determining completing of the break-in process for the elastic membrane 10, and a controller 52 for controlling operations of at least the fluid supply unit 60 and the break-in determination module 57.

Further, the break-in processing apparatus 50 shown in FIG. 4 includes a processing chamber 51 for performing the break-in process for the elastic membrane 10, a control box 53 for housing the fluid supply unit 60 and the controller 52, a coupling head 55 for coupling the fluid supply unit 60 to the elastic membrane assembly 7, and a display 56 capable of displaying a recipe for the break-in process and results of the break-in process. The display 56 is connected to the controller 52, and an operator can use the display 56 to check the recipe for the break-in process stored in advance in the controller 52. Further, the operator can modify the recipe for break-in process displayed on the display 56 using an input device (e.g., keyboard and mouse), which is not shown in the drawings, and can create a new recipe for break-in process.

In this embodiment, the stage 54 includes a main stage 54*a*, an elastic-membrane stage 54*b*, and a retainer-ring stage 54*c*. The elastic-membrane stage 54*b* and the retainer-ring stage 54*c* are fixed to an upper surface of the main stage 54*a* The elastic-membrane stage 54*b* has a disk-shape, and has a diameter smaller than an outer diameter of the elastic membrane 10. The retainer-ring stage 54*c* has a ring shape, and has an upper surface configured to support a lower surface of the retainer ring 3. The elastic-membrane stage 54*b* and the retainer-ring stage 54*c* are concentrically arranged with each other.

When the retainer ring 3 is placed on the retainer-ring stage 54*c*, a center of the elastic membrane 10 is located on a straight line extending vertically through a center of the elastic-membrane stage 54*b*, and a lower surface of the elastic membrane 10 is in contact with the upper surface of the elastic membrane stage 54, or faces the upper surface of the elastic-membrane stage 54*b* with a small gap. Therefore, when the elastic membrane assembly 7 is placed on the stage 54, an outer periphery portion of the elastic membrane 10 is located above an annular gap formed between the elastic-membrane stage 54*b* and the retainer-ring stage 54*c*.

Although not shown in the drawings, the break-in processing apparatus 50 may have a sliding mechanism to move the stage 54 between an inside and an outside (see dotted line in FIG. 4) of the processing chamber 51. The sliding mechanism causes the stage 54 to be pulled outside of the processing chamber 51, allowing an operator to easily place the elastic membrane assembly 7 on the stage. The sliding mechanism is, for example, composed of a rail coupling to the main stage 54*a*, and a moving mechanism that moves the stage 54 along the rail. Examples of the moving mechanism include a piston-cylinder mechanism and a ball-screw mechanism. In one embodiment, the moving mechanism may be omitted. In this case, the stage 54 is moved manually.

The break-in determination module 57 is disposed in the annular gap formed between the elastic membrane stage 54*b* and the retainer-ring stage 54*c*. Usually, an area where the break-in process is particularly required is the outermost periphery portion of the elastic membrane 10. In the outermost periphery portion of the elastic membrane 10, the circumferential wall 10*h*, which corresponds to the side wall of the elastic membrane 10, and the circumferential wall 10*g* positioned to an inner side of the circumferential wall 10*h* seal a gap between the elastic membrane 10 and the carrier 8. Since an outside of the circumferential wall 10*h* is at atmospheric pressure, the circumferential wall 10*h* tries to expand outward, when a pressurized fluid is supplied to the edge pressure chamber 14*a* which is partitioned by the circumferential walls 10*g* and 10*h* When the circumferential wall 10*h* expands outward, a downward pressing force of the edge pressure chamber 14*a* pressing the wafer W against the polishing surface 19*a* of the polishing pad 19 is reduced, and therefore, the elasticity at the outermost periphery of the elastic membrane 10 has the greatest effect on the polishing of the wafer W.

In contrast, each of the pressure chambers other than the outermost periphery portion of the elastic membrane 10 is partitioned by adjacent circumferential walls of the circumferential walls 10*a* to 10*g*, and the pressure of the pressurized fluid acts on the outside of these circumferential walls as well. Accordingly, the elasticity of the elastic membrane 10 other than the outermost periphery portion of the elastic membrane 10 has hardly any effect on the polishing of the wafer W. Therefore, determining the elasticity of the outermost periphery portion of the elastic membrane 10 enables the completion of the break-in process for the elastic membrane 10 to be determined. In this embodiment, the break-in determination module 57 is used to measure the elasticity of the outermost periphery portion of the elastic membrane 10, and the controller 52 determine the completion of the break-in process for the elastic membrane 10 based on the measure t result of the break-in determination module 57.

The coupling head 55 is disposed in the processing chamber 51, and can be moved vertically by the vertical movement mechanism (not shown). When performing the break-in process, the coupling head 55 is coupled to the elastic membrane assembly 7 placed on the stage 54 such that the pressurized fluids from the fluid supply unit CO, which will be described below, can be independently supplied into the pressure chambers 12, 14*a*, 14*b*, 16*a* to 16*e* of the elastic membrane 10.

Figure 5:
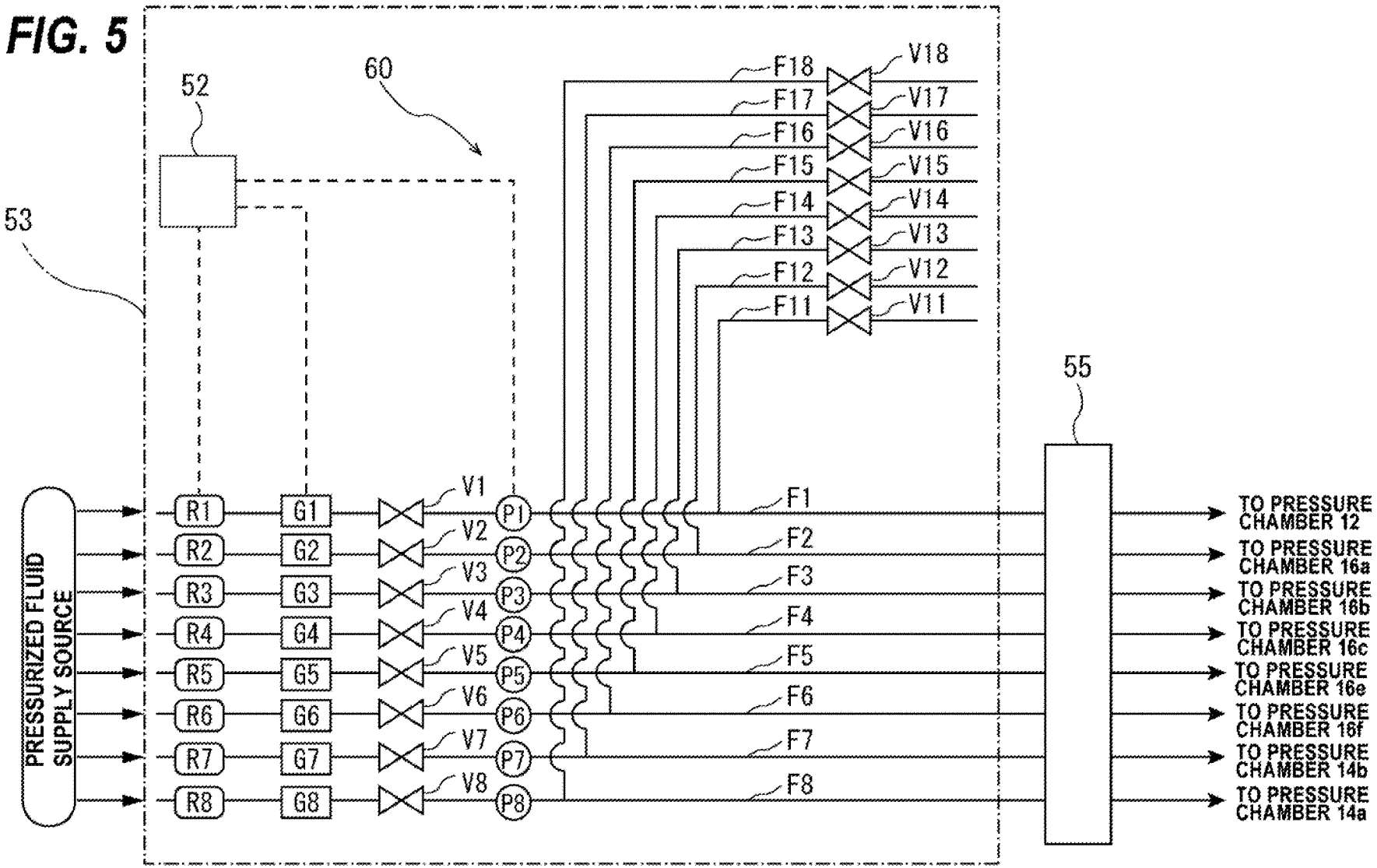
FIG. 5 is a schematic view showing an example of a fluid supply unit shown FIG. 4.

FIG. 5 is a schematic view showing an example of the fluid supply unit 60 shown in FIG. 4. The fluid supply unit 60 shown in FIG. 5 has fluid delivery lines F1, F2, F3, F4, F5, F6, F7, and F8 which are provided corresponding to the pressure chambers 12, 14*a*, 14*b* and 16*a* to 16*e*, respectively. One ends of each of the fluid delivery lines F1, F2, F3, F4, F5, F6, F7, and F8 are coupled to a fluid supply source. The fluid supply source is, for example, a pressurized fluid supply source as a utility provided in the factory where the polishing apparatus is installed. Other ends of each of the fluid delivery lines F1, F2, F3, F4, F5, F6, F7, and F8 are coupled to the coupling head 55 disposed in the processing chamber 1.

The coupling head 55 has inner fluid passages (not shown) for coupling the fluid delivery lines F1 to F8 to the fluid passages 20, 22, 24*a* to 24*f*, respectively, which provided in the carrier 8, when the elastic membrane assembly 7 is installed to the coupling head 55. The pressurized fluids, such as compressed air, are supplied to the pressure chambers 12, 14*a*, 14*b* 16*a* to 16*e* through the fluid delivery lines F1, F2, F3, F4, F5, F6, F7, and F8 of the fluid supply unit 60, and the inner fluid channels of the coupling head 55, respectively.

Pressure regulators R1, R2, R3, R4, R5, R6, R7, and R8 are provided on the fluid delivery lines F1, F2, F3, F4, F6, F7, and F8, respectively. The pressurized fluids from the pressurized fluid supply source are independently supplied to the pressure chambers 12, 14*a*, 14*b*, 16*a* to 16*e* through the pressure regulators R1 to R8, respectively. The pressure regulators R1 to R8 are configured to regulate independently the pressure of the pressurized fluid in the pressure chambers 12, 14 *a*, 14*b*, 16*a* to 16*e*.

Pressure release lines F11, F12, F13, F14, F15, F16, F17, and F18 are connected to the fluid delivery lines F1, F2, F3, F4, F5, F6, F7, and F8, respectively, the pressure release lines being used for opening the pressure chambers 12, 14*a*, 14*b*, 16*a* to 16*e* to atmosphere. Pressure release valves V11, V12, V13, V14, V15, V16, V17, and VIS are provided on the pressure release lines F11, F12, F13, F14, F15, F16, F17, and F18, respectively.

Open/close valves V1, V2, V3, V4, V5, V6, V7, and V8 are provided on the fluid delivery lines F1, F2, F3, F4, F5, F6, F7, and F8, respectively, and the pressure release lines F11, F12, F13, F14, F15, F16, F17, and F18 are connected to the fluid delivery lines F1, F2, F3, F4, F5, F6, F7, and F8 at downstream of the open/close valves V1, V2, V3, V4, V5, V6, V7, and V8, respectively. The open/close valves V1, V2, V3, V4, V5, V6, V7, and V8, and the pressure release valves V11, V12, V13, V14, V15, V16, V17, and V18 are connected to the controller 52. The controller 52 can control open/close operations of each of the open/close valves V1 to V8, and open/close operations of each of pressure release valve V11 to V18, independently.

The open/close valves V1 to V8 and the pressure release valves V11 to V18 are normally closed. When the controller 52 causes the open/close valves V1 to V8 to be opened, the pressurized fluids are supplied from the pressurized fluid supply source to the pressure chambers 12, 14*a*, 14*b*, and 16*a* to 16*e* to thereby stretch (expand) the elastic membrane 10. In this state, when the controller 52 causes the open/close valves V1 to V8 to be closed, and the pressure release valves V11 to V18 to be opened, the pressure chambers 12, 14*a*, 14*b*, and 16*a* to 16*e* are opened to atmosphere to thereby contract the elastic membrane 10. By expanding and contracting the elastic membrane 10 in this manner, the break-in process for the elastic membrane 10 is performed.

Figure 6A:
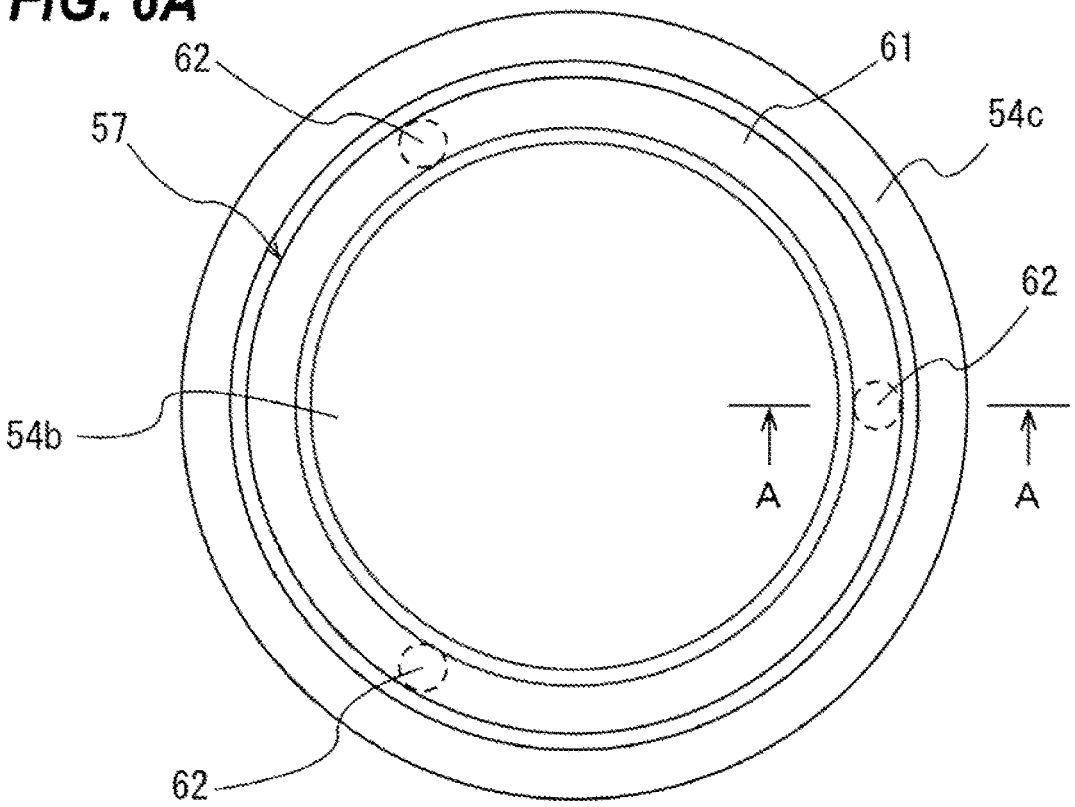
FIG. 6A is a top view schematically showing a break-in determination module according to one embodiment.
Figure 6B:
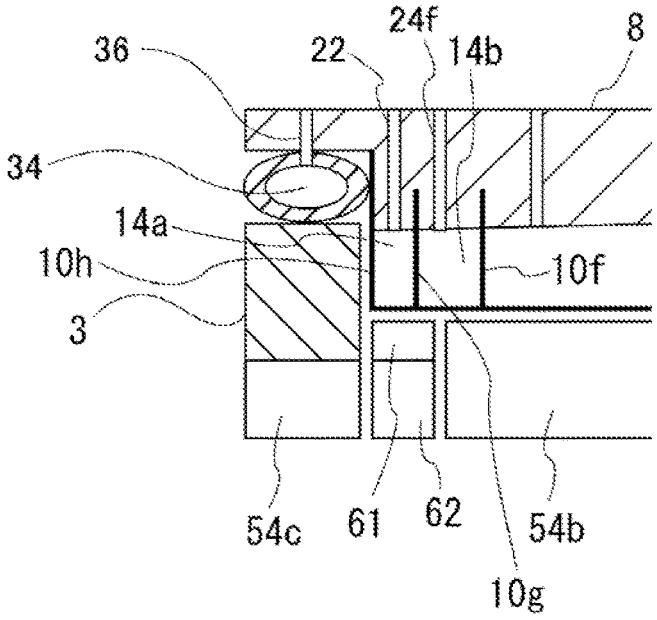
FIG. 6B is a cross-sectional view taken along line A-A in FIG. 6A.

FIG. 6A is a top view schematically showing the break-in determination module 57 according to one embodiment, and FIG. 6B is a cross-sectional view taken along line A-A in FIG. 6A. The break-in determination module 57 shown in FIGS. 6A and 6B has a load distributing ring 61 facing the outermost periphery portion of the elastic membrane 10, and at least one load measuring device 62.

The load distributing ring 61 is a tool which, when the pressurized fluid is supplied to the edge pressure chamber 14*a* of the elastic membrane 10 from the fluid supply source 60, is in contact with the lower surface of the outermost periphery portion of the elastic membrane 10, to evenly apply the load to the at least one load measuring device 6. The outermost periphery portion of the elastic membrane 10 that the load distributing ring 61 faces may be an area which includes the edge pressure chamber 14*a*, and further reach to a region of the edge pressure chamber 14*b* positioned inside of the edge pressure chamber 14*a*, or may be a part of a region of the edge pressure chamber 14*a*.

In order to accurately measure the load applied from the elastic membrane 10 to the load distributing ring 61, it is preferred that a plurality of load measuring devices 62 are arranged at equal intervals along a circumferential direction of the load distributing ring 61. In the break-in determination module 57 shown in FIGS. 6A and 6B, three load measuring devices 62, which are a load cell, are arranged at equal intervals along the circumferential direction of the load distributing ring 61.

In one embodiment, the load measuring device 62 may be a pressure-sensitive sensor capable of measuring a distribution of the load, which is pressed by the outermost peripheral portion of the elastic membrane 10, in a radial direction of the elastic membrane 10. In the case where the load measuring device 62 is the pressure sensitive sensor, the load distributing ring 61 is omitted. Examples of such a pressure-sensitive sensor include a tactile sensor manufactured by Nitta Corporation, and a tactile pressure sensor manufactured by PPS. When the pressure-sensitive sensor is used for the load measuring device 62 of the break-in determination module 57, the break-in determination module 57 may have a plurality of pressure-sensitive sensors arranged along the circumferential direction of the elastic membrane 10, or may have only one pressure-sensitive sensor. In the case where the break-in determination module 57 has only one pressure-sensitive sensor as the load measuring device 62, it is preferred that the pressure-sensitive sensor has the same shape as that of the outermost periphery portion of the elastic membrane 10 in a horizontal direction.

In one embodiment, the controller 52 of the break-in processing apparatus 50 may calculate a correction coefficient and/or a correction formula for correcting a polishing recipe for the polishing process performed in the polishing apparatus, based on the pressure of pressurized fluid supplied into the edge pressure chamber 14*a* and the load (pressure) distribution obtained by the pressure-sensitive sensor which is the load measuring device 62. More specifically, the controller 52 of the break-in processing apparatus 50 calculates a correction coefficient and/or a correction formula for correcting a polishing load of the polishing recipe that is stored in advance in the controller 40 of the polishing apparatus, such that the load distribution obtained by the pressure-sensitive sensor comes close to a reference distribution which will be described below. In this case, the correction coefficient and/or the correction formula calculated by the controller 52 of the break-in processing apparatus 50 is input to the controller 40 of the polishing apparatus, and the controller 40 of the polishing apparatus corrects the polishing load of the polishing recipe based on the correction coefficient and/or the correction formula. This operation enables optimal polishing of the wafer W, which takes into account individual differences in the elastic membranes 10 before and after replacement (e.g., slight dimensional differences, slight hardness differences in the material, and so on), to be performed.

When the retainer ring 3 is placed on the retainer-ring stage 54*c*, the lower surface of the outermost periphery portion of the elastic membrane 10 (in this embodiment, the lower surface of the elastic membrane 10 forming the edge pressure chamber 14*a*) faces the load distributing ring 61 (or pressure-sensitive sensor). A small gap is formed between the elastic membrane 10 and the load distributing ring 61 (or pressure-sensitive sensor). When performing the break-in process, the pressurized fluid is supplied from the pressurized fluid source to at least the edge pressure chamber 14*a*. More specifically, the controller 42 causes at least the open/close valve V8 (see FIG. 5) to be opened, thereby supplying the pressurized fluid, which is regulated to a predetermined pressure by the pressure regulator R8, into the edge pressure chamber 14*a*.

In one embodiment, all of the pressure chambers 12, 14*a*, 14*b*, 16*a* to 16*e* may be supplied with pressurized fluid, or some of the pressure chambers 12, 14*a*, 14*b*, 16*a* to 16*e*, including the pressure chamber 14*a* may be supplied with the pressurized fluid. In recent years, the number of pressure chambers in the elastic membrane 10 has tended to increase in order to improve a controllability of the film thickness profile of the wafer W after polishing. In this case, the elasticity in shape of the partition walls for partitioning each pressure chamber may not be ensured to be sufficient for design purposes. In such cases, the elastic membrane 10 other than the area of the outermost periphery portion is also stretched and contracted to thereby enhance the elasticity of the elastic membrane 10. The controller 52 can open open/close valves disposed in the fluid delivery lines communicating with the corresponding pressure chambers to supply the pressurized fluids with a predetermined pressure into the desired pressure chambers.

Next, a method of performing the break-in process by use of the break-in processing apparatus 50 according to the embodiments described above will be described below.

Figure 7:
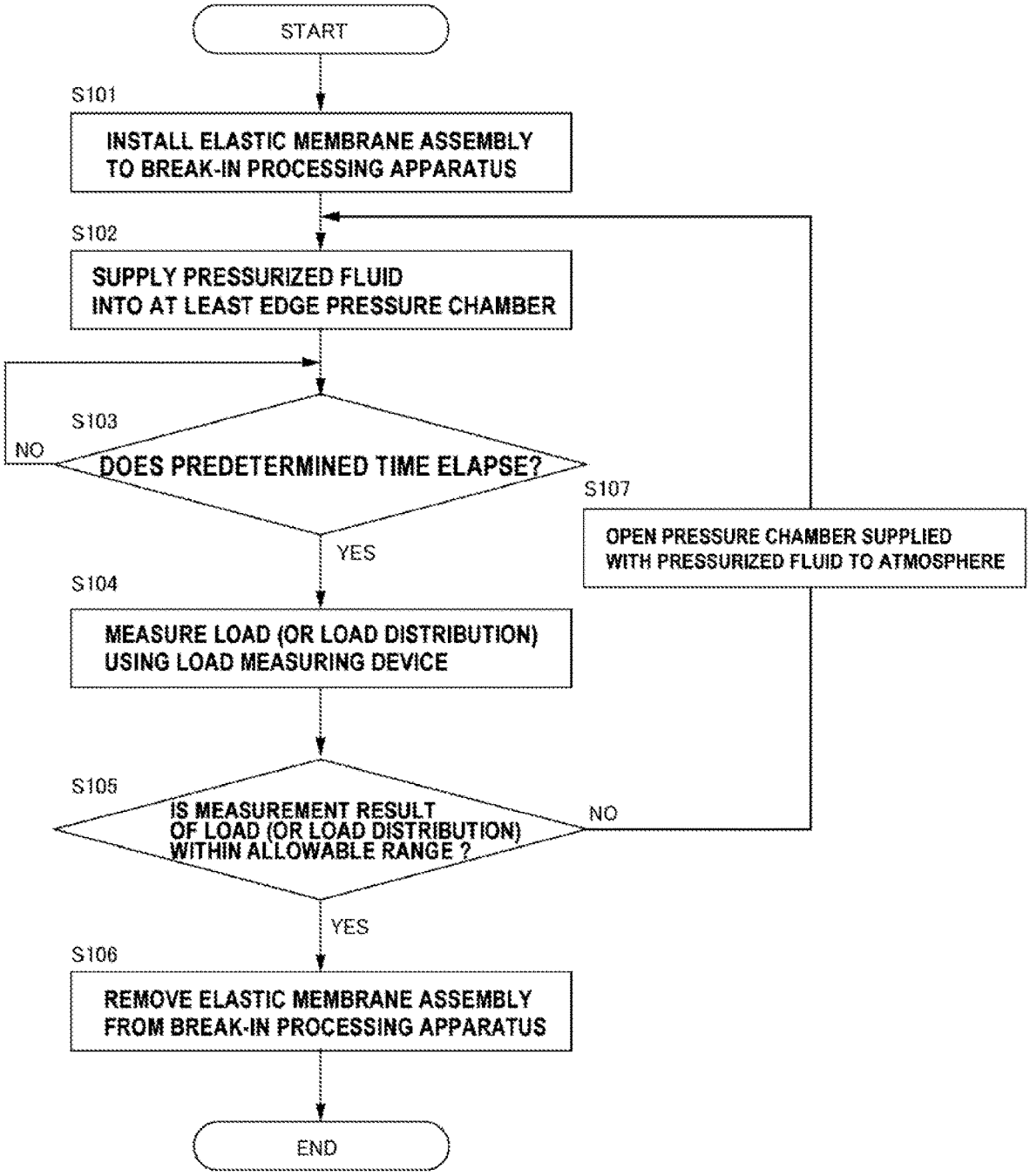
FIG. 7 is a flowchart showing an example of a break-in process.

FIG. 7 is a flowchart showing an example of a break-in process. As shown in FIG. first, the elastic membrane assembly 7 with the new elastic membrane 10 attached is installed in the break-in processing apparatus 50 (S101). More specifically, the elastic membrane assembly 7 is placed on the stage 54, and in this state, the coupling head 55 is attached to the elastic membrane assembly 7. With this operation, the outermost periphery portion of the elastic membrane assembly 7 faces the break-in determination module 57, and each pressure chamber 12, 14*a*, 14*b*, 16*a* to 16*e* of the elastic membrane 10 can be supplied with the pressurized fluid having a predetermined pressure.

Next, the pressurized fluid with the predetermined pressure regulated by the pressure regulator R8 is supplied to the edge pressure chamber 14*a* (S102). At this time, any or all of the pressure chambers 12, 14*b*, 16*a* to 16*e* may be supplied with pressurized fluid having the predetermined pressure. In one embodiment, the pressurized fluids may be repeatedly supplied and opened to atmosphere (depressurized) to the edge pressure chambers 14*a*, and any or all of the pressure chambers 12, 14*b*, 16*a* to 16*e* other than edge pressure chamber 14*a*, and then the pressurized fluids may be supplied to the edge pressure chamber 14*a*, and any or all of the pressure chambers 12, 14*b*, 16*a* to 16*e* other than edge pressure chamber 14*a*. Next, the controller 52 checks whether or not a predetermined time has elapsed (S103). After the predetermined time has elapsed, the load measuring device 62 of the break-in determination module 57 is used to measure the load (or the load distribution in the radial direction of the elastic membrane 10) that the outermost periphery portion of the elastic membrane 10 is pressing the load distributing ring 61 (S104).

Figure 8:
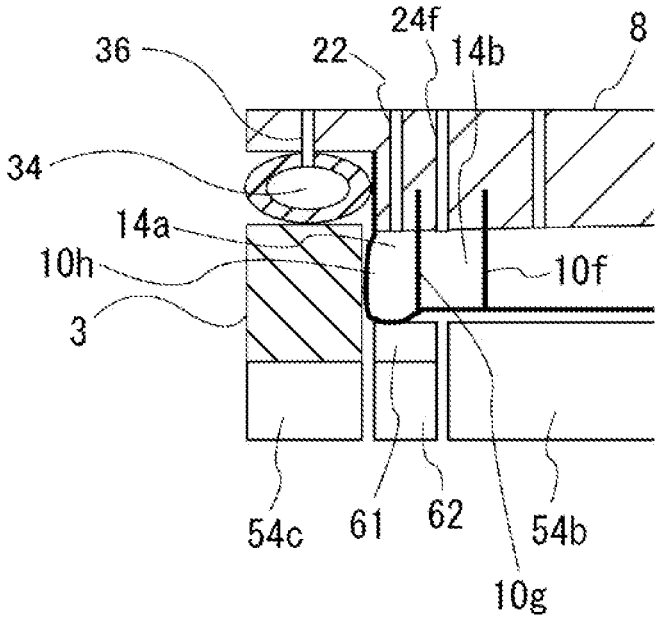
FIG. 8 is a schematic view showing a state where a pressurized fluid is supplied to an edge pressure chamber to expand an outermost periphery portion of the elastic membrane.

FIG. 8 is a schematic view showing a state where the pressurized fluid is supplied to the edge pressure chamber 14*a* to expand the outermost periphery portion of the elastic membrane 10. The outermost periphery portion of the elastic membrane 10, expanded by the pressurized fluid presses the load measuring device 62, which is a load cell, through the load distributing ring 61. In the case where the load measuring device 62 is the pressure-sensitive sensor, the outermost periphery portion of the elastic membrane 10 expanded by the pressurized fluid directly presses the load measuring device 62, which is the pressure-sensitive sensor. The load measuring device 62 measures the load (or the load distribution in the radial direction of the elastic membrane 10) that the outermost periphery portion of the elastic membrane 10 is pressing the load distributing ring 61, and sends measurement result thereof to the controller 52.

The controller 52 compares the measurement result of the load measuring device 62 with an allowable range which is set in advance with respect to a reference value, and determines whether or not the measurement result of the load measuring device 62 is within the allowable range (S105). The controller 52 stores in advance the above reference value and the allowable range set with respect to the reference value.

When the elastic membrane 10 does not have sufficient elasticity (flexibility), the elastic membrane 10 cannot be stretched sufficiently. Therefore, the measurement value of the load measuring device 62 is lower than a measurement value when the outermost periphery portion of the elastic membrane 10 having an appropriate elasticity presses the load measuring device 62. The controller 52 compares the measurement result of the load measuring device 62 with the allowable range set in advance with respect to the reference value, thereby determining whether or not the break-in process for the elastic membrane 10 is completed.

In the case where the break-in determination module 57 has a plurality of load measuring devices 62, an average of the measurement values of these load measuring devices 62 can be used as the measurement result for comparison with the allowable range. In one embodiment, the maximum or minimum of the measurement values of the plurality of load measuring devices 62 may be used as the measurement result for comparison with the allowable range. Further, if any one of the measurement values of the plurality of load measuring devices 62 deviates from the allowable range, it may be determined that the break-in process is not completed.

Further, a sum of the measurement values of the plurality of load measuring devices 62 may be used as the measurement result for comparison with the allowable range. In this case, a value obtained by multiplying a reference value set for one load measuring device 62 by the number of load measuring devices 62 is used as the reference value with which the measurement result is compared. Thus, the allowable range is set for this reference value obtained in this manner.

In the case where the load measuring device 62 is the load cell, when the elastic membrane 10 does not have sufficient elasticity, the measurement result of the load measuring device 62 is lower than the reference value. In this case, the fact that the measurement result of the load measuring device 62 is within the allowable range corresponds to the fact that the measurement result of the load measuring device 62 is equal to or greater than the reference value.

In the case where the load measuring device 62 is the pressure-sensitive sensor described above, the reference value is a reference distribution of the load that the outermost periphery portion of the elastic membrane 10 is pressing, in the radial direction of the elastic membrane 10.

Figure 9A:
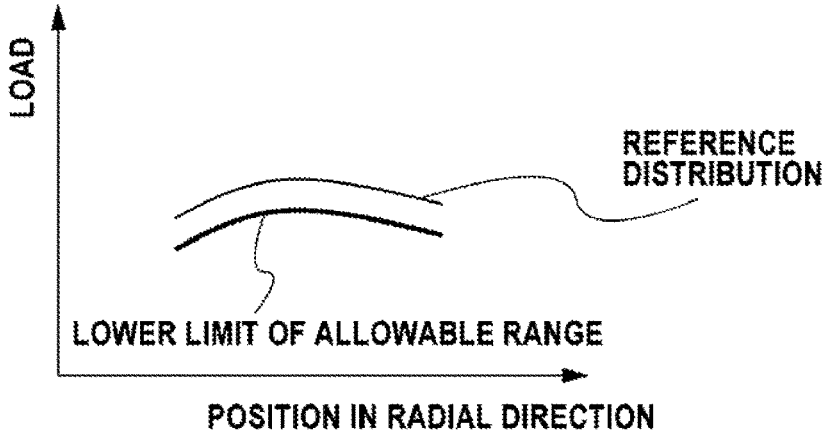
FIG. 9A is a graph showing an example of a reference distribution of a load that the outermost periphery portion of the elastic membrane is pressing, in the radial direction of the elastic membrane, and an allowable range set with respect to this reference distribution.
Figure 9B:
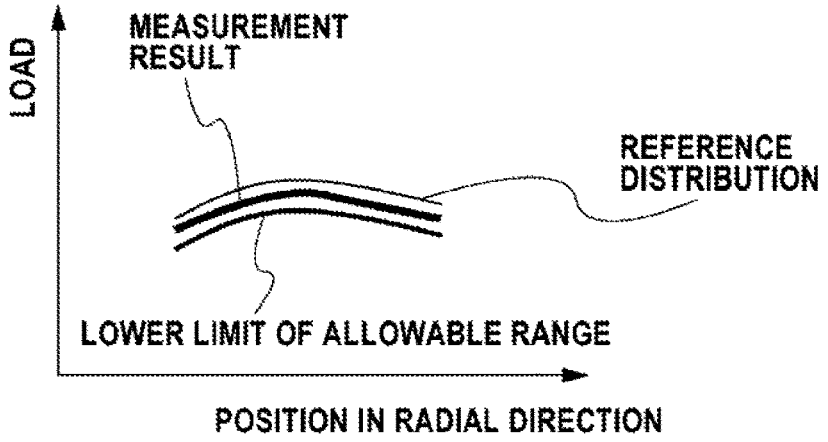
FIG. 9B is a graph showing a state where measurement result by a pressure-sensitive sensor is within the allowable range shown in FIG. 9A.
Figure 9C:
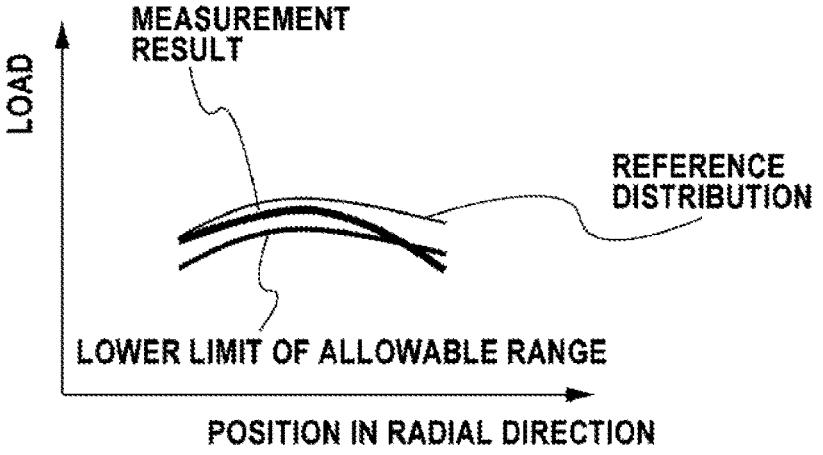
FIG. 9C is a graph showing a state where measurement result by the pressure-sensitive sensor deviates from the allowable range shown in FIG. 9A.

FIG. 9A is a graph showing an example of a reference distribution of the load that the outermost periphery portion of the elastic membrane 10 is pressing, in the radial direction of the elastic membrane 10, and an allowable range set with respect to this reference distribution. FIG. 9B is a graph showing a state where the measurement result by the pressure-sensitive sensor is within the allowable range shown in FIG. 9A. FIG. 9C is a graph showing a state where the measurement result by the pressure-sensitive sensor deviates from the allowable range shown in FIG. 9A. The controller 52 stores in advance the graph as shown in FIG. 9A, and determines whether or not the load distribution obtained by the pressure-sensitive sensor is within the allowable range.

When the measurement result of the load measuring device 62, which is the load cell, is equal to or greater than the reference value, or when the measurement result of the load measuring device 62, which is the pressure-sensitive sensor, is within the allowable range as shown in FIG. 9 B ("YES" in S105), the controller 52 determines that the elastic membrane 10 has acquired sufficient elasticity and completes the break-in process for the elastic membrane. In this case, the elastic membrane assembly 7 can be removed from the break-in processing apparatus (S106).

In contrast, when the measurement result of the load measuring device 62, which is the load cell, is lower than the reference value, or when the measurement result of the load measuring device 62, which is the pressure-sensitive sensor, deviates from the allowable range as shown in FIG. 9C ("NO" in S105), the controller 52 determines that the elasticity of the elastic membrane 10 is insufficient, and repeats the break-in operation shown in S102 to S105. In this case, the controller 52 causes the pressure chambers into which the pressurized fluids have been supplied, of the pressure chambers 12, 14*a*, 14*b*, 16*a* to 16*e* to be opened to atmosphere (S107). This operation enables the elastic membrane 10 to repeat the expanding action by used of the pressurized fluid and the contracting action due to the opening to atmosphere until acquiring sufficient elasticity.

According to this embodiment, the break-in process for the elastic membrane 10 can be reliably completed before the elastic membrane assembly 7 is installed in the polishing apparatus. Therefore, after the elastic membrane assembly 7 is installed in the polishing apparatus, there is no need to perform the break-in process for the elastic membrane 10, and further there is no need to confirm that the elastic membrane 10 has acquired sufficient elasticity. As a result, a reduction in the utilization rate of the polishing apparatus can be prevented.

Further, a standby elastic membrane assembly 7 with elastic membrane 10 attached which has been confirmed to be completed the break-in process by the break-in processing apparatus 50 may be prepared. In this case, the elastic membrane assembly 7 in use can be exchanged with the standby elastic membrane assembly 7, allowing the polishing apparatus to be put into operation as quickly as possible.

Figure 10A:
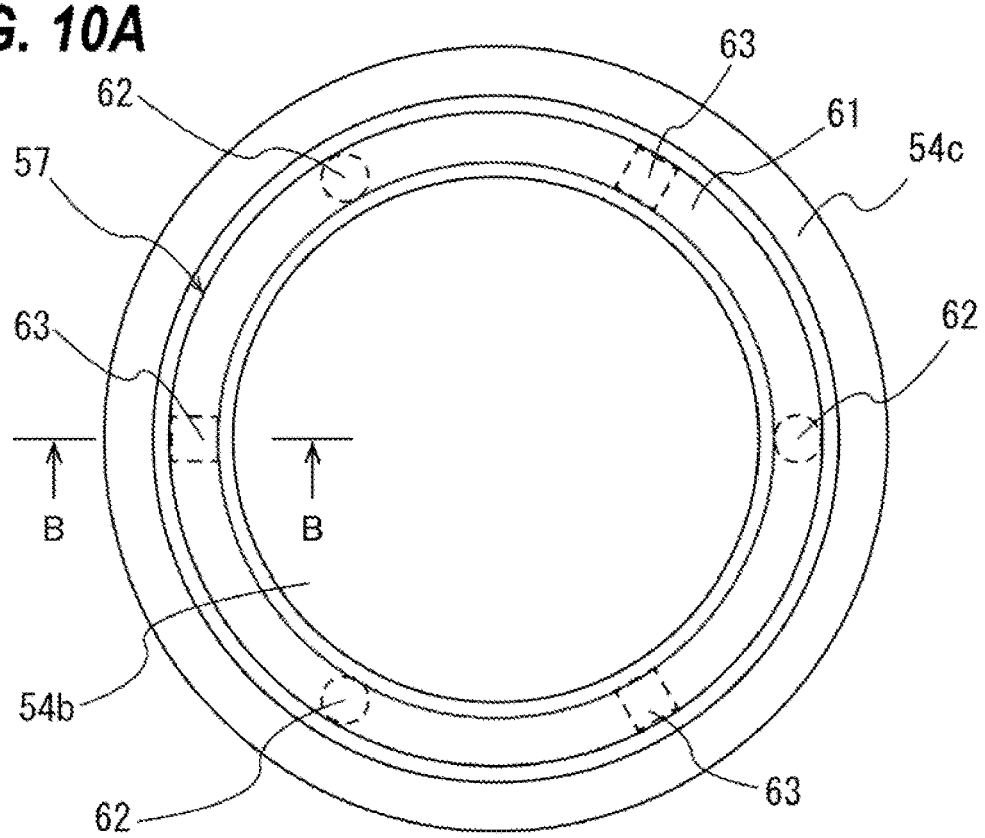
FIG. 10A is a top view of the break-in determination module according to another embodiment.
Figure 10B:
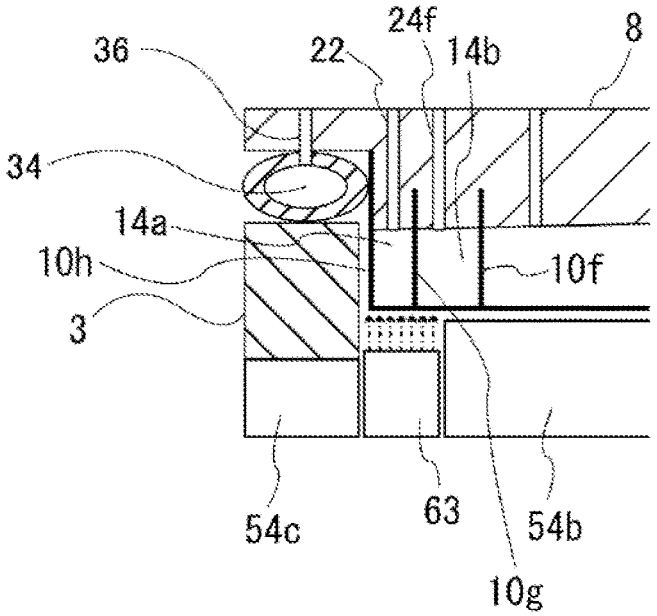
FIG. 10B is a cross-sectional view taken along line B-B in FIG. 10A.

FIG. 10A is a top view of the break-in determination module 57 according to another embodiment, and FIG. 10B is a cross-sectional view taken along line B-B in FIG. 10A. Configurations of this embodiment other than the break-in determination module 57 are the same as those of the embodiments described above, and thus duplicate descriptions thereof will be omitted.

The break-in determination module 57 shown in FIGS. 10A and 10B differs from the break-in determination module 57 according to the embodiments described above in that it further has at least one shape measuring device 63 that additionally determines whether or not the break-in process of the elastic membrane 10 is completed.

In this embodiment, the break-in determination module 57 has three shape measuring devices 63, and each shape measuring device 63 is a two-dimensional displacement sensor that emits a laser beam to the lower surface of the outermost periphery portion of the elastic membrane 10 to obtain a two-dimensional shape of the lower surface of the outermost periphery portion of the elastic membrane 10. However, the type of shape measuring device 63 is not limited to this embodiment. For example, the shape measuring device 63 may be an imaging device that obtains a two-dimensional shape of the lower surface of the outermost periphery portion of the elastic membrane 10 as image data.

When the break-in process is performed on the elastic membrane 10, the elasticity of the elastic membrane 10 is increased. As a result, in a state where the pressure chambers 12, 14*a*, 14*b*, 16*a* to 16*e* of the elastic membrane 10 attached to the carrier S are opened to atmosphere, the lower surface of the outermost periphery portion of the elastic membrane 10 after the break-in process is displaced downward by its own weight compared to the lower surface of the elastic membrane 10 before the break-in process (i.e., the unused elastic membrane 10).

Figure 11A:
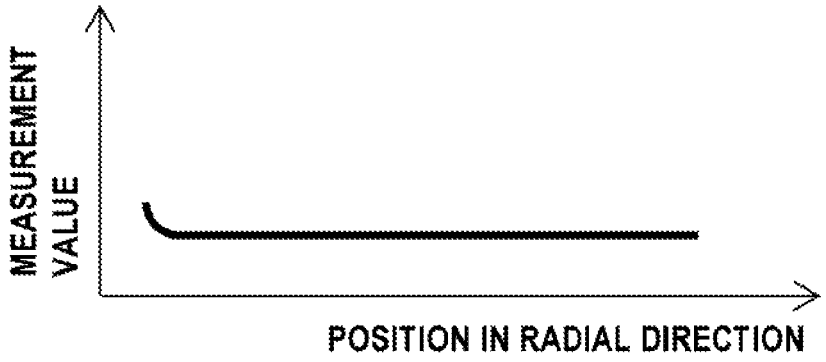
FIG. 11A is a graph showing measure milt result of the lower surface of the outermost periphery portion of an unused elastic membrane measured with a two-dimensional displacement sensor.
Figure 11B:
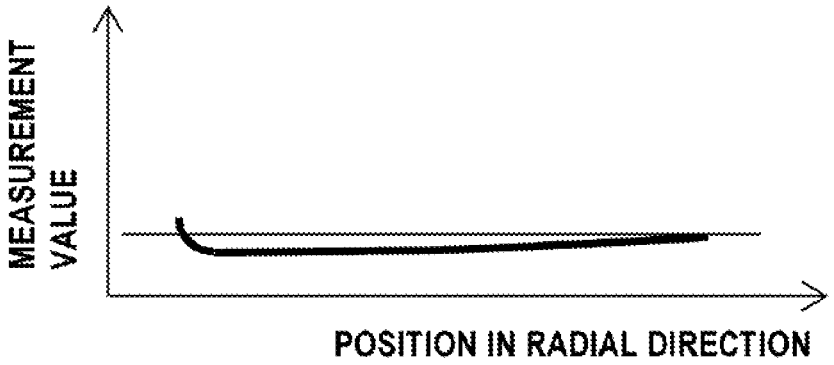
FIG. 11B is a graph showing measurement result of the lower surface of the outermost periphery portion of the elastic membrane after the break-in process has been completed with the two-dimensional displacement sensor.

FIG. 11A is a graph showing measurement result of the lower surface of the outermost periphery portion of the unused elastic membrane 10 measured with the two-dimensional displacement sensor, and FIG. 11B is a graph showing measurement result of the lower surface of the outermost periphery portion of the elastic membrane 10 after the break-in process has been completed with the two-dimensional displacement sensor. As shown in FIG. 11A, the lower surface of the outermost periphery portion of the elastic membrane 10 with insufficient elasticity extends horizontally. The lower surface of the outermost periphery portion of the elastic membrane 10, which has sufficient elasticity due to the break-in process, is displaced downward by its own weight.

In this embodiment, the completion of the break-in process is determined by the determination based on the load applied to the load measuring device 62, as well as a determination based on the change in the shape of the elastic membrane 10 obtained by the shape measuring device 63. In other words, the completion of the break-in process which has been determined based on the load applied to the load measuring device 62, is confirmed by the determination based on the change in the shape of the elastic membrane 10 obtained by the shape measuring device 63.

Figure 12:
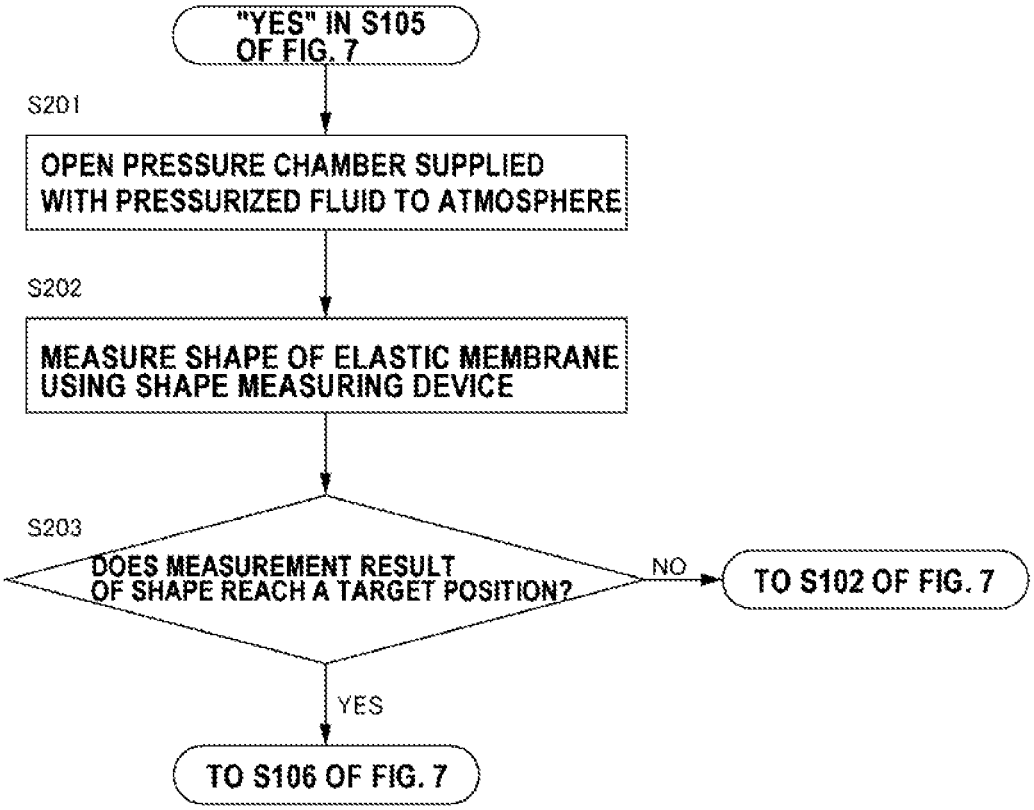
FIG. 12 is a flowchart of a confirmation method for confirming that the break-in process of the elastic membrane is completed.

Hereafter, with reference to FIG. 12, a break-in processing method using the break-in determination module 57 shown in FIGS. 10A and 10B will be described. FIG. 12 is a flowchart of a confirmation method for confirming that the break-in process of the elastic membrane 10 is completed. This method is identical to the flowchart described in FIG. 7 until the process of determining with the load measuring device 62, such as a load cell, that the break-in process is completed. Therefore, the description of the steps until S105 shown in FIG. 7 is omitted.

In this embodiment, when the load measuring device 62 determines that the break-in process is completed (i.e., "Yes" in S105 of FIG. 7), the controller 52 causes the pressure chambers into which the pressurized fluid has been supplied, of the pressure chambers 12, 14*a*, 14*b*, 16*a* to 16*e* to be opened to atmosphere (S201). Next, the controller 52 measures the shape of the lower surface of the outermost periphery portion of the elastic membrane 10 by use of the shape measuring device 63, and obtains the measurement result thereof. The controller 52 determines whether or not the measurement result of the shape measuring device 63 has reached a target position. The controller 52 stores in advance the target position.

Figure 13A:
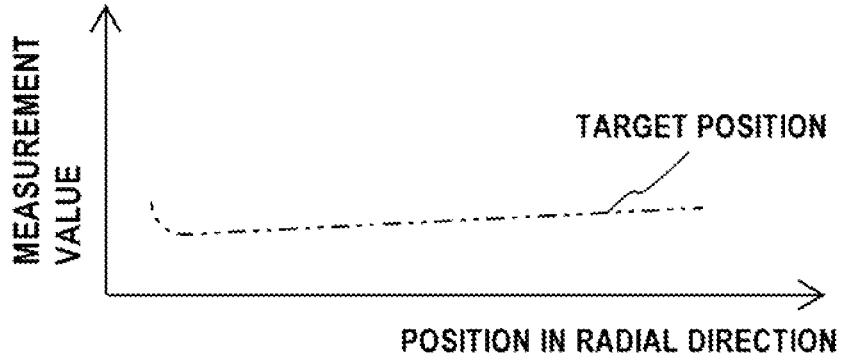
FIG. 13A is a graph showing a target position stored in advance in a controller.
Figure 13B:
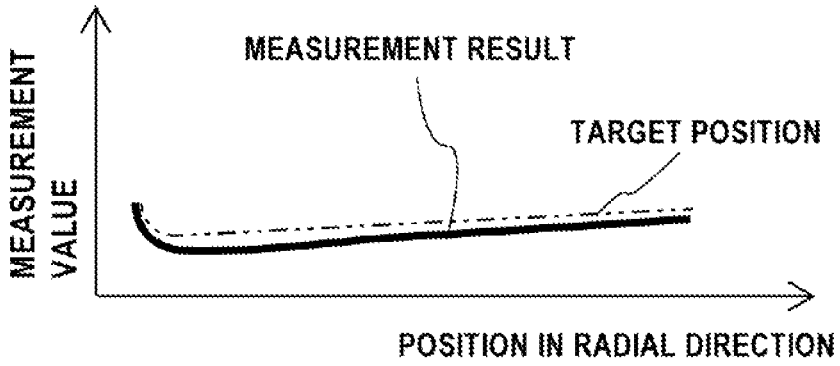
FIG. 13B is a graph showing an example in which measurement result of a shape measuring device has reached the target position.
Figure 13C:
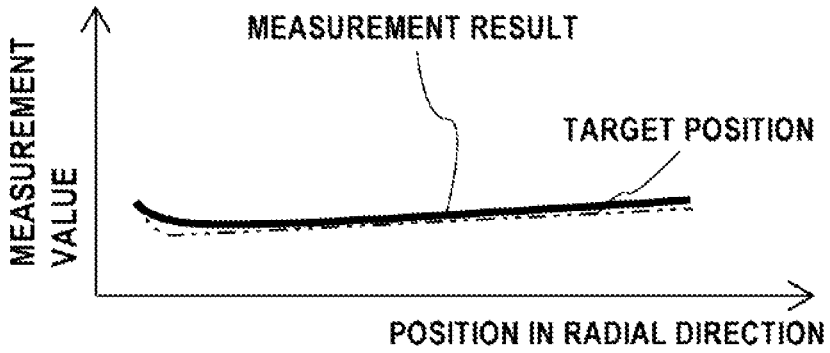
FIG. 13C is a graph showing an example in which measurement result of the shape measuring device has not reached the target position.

FIG. 13A is a graph showing the target position stored in advance in the controller 52, FIG. 13B is a graph showing an example in which the measurement result of the shape measuring device 63 has reached the target position, and FIG. 13C is a graph showing an example in which the measurement result of the shape measuring device 63 has not reached the target position.

As shown in FIG. 13B, when the measurement result of the shape measuring device 63 has reached the target position, the controller 52 determines that the break-in process is definitely completed. In this case, the elastic membrane assembly 7 is removed from the break-in processing apparatus (see S106 in FIG. 7).

As shown in FIG. 13C, when the measurement result of the shape measuring device 63 has not reached the target position, the controller 52 determines that the break-in process has not been completed, and repeats the break-in operation shown in S102 to S105 of FIG. 7.

Thus, in this embodiment, the completion of the break-in process is determined based on not only the load applied to the load measuring device 62, but also the change in the shape of the elastic membrane 10 acquired by the shape measuring device 63. Therefore, it can more reliably determine that the break-in process is completed.

In one embodiment, the load measuring device 62 may omitted, and the completion of the break-in process may be determined by using only the measurement result of the shape measuring device 63.

In the break-in processing unit 50 according to the embodiments described above, the fluid supply device 60 can be used to supply the pressurized fluids from the pressurized fluid supply source to each of the pressure chambers 12, 14*a*, 14*b*, 16*a* to 16*e*. Therefore, this break-in process device 50 can be used to perform a leak check of the new elastic membrane 10 attached to the carrier 8. In other words, the break-in process apparatus 50 can be used to check for fluid leakage from a gap between the carrier 8 and the elastic membrane 10.

Returning to FIG. 5, in order to check the fluid leakage from the gap between the elastic membrane 10 and the carrier 8 in the break-in processing apparatus 50, the fluid supply unit 60 has pressure sensors P1, P2, P3, P4, P5, P6, P7, and P8 which are attached to each of the fluid delivery lines F1 to F8. The pressure sensors P1 to P8 can measure pressures of the pressurized fluids in the fluid delivery lines F1 to F8, respectively.

Since the pressure sensors P1 to P8 communicate with the pressure chambers 12, 14*a*, 14*b* and 16*a* to 16*e* through the fluid delivery lines F1 to F8, respectively, the pressure sensors P1 to P8 can measure the pressures of the pressurized fluids in the pressure chambers 12, 14*a*, 14*b* and 16*a* to 16*e*, respectively. In this embodiment, the pressure sensors P1 to P8 are disposed at a secondary side (downstream side) of the open/close valves V1 to V8, respectively, disposed between the open/close V1 to V8 and the pressure chambers 12, 14*a*, 14*b* and 16*a* to 16*e*, respectively. The pressure sensors P1 to P8 are connected to the controller 52, and measured values of the pressure of the pressurized fluid in each of the fluid delivery lines F1 to F8 are sent from the pressure sensors P1 to P8 to the controller 52.

As shown in FIG. 5, the fluid supply unit 60 further includes flowmeters G1, G2, G3, G4, G5, G6, G7, and F8 for measuring flow rates of the pressurized fluid flowing in each of the fluid delivery lines F1 to F8, respectively. The flow meters G1 to G8 are located between the pressure regulators R1 to R8 and the open close valves V1 to V8. The flow meters G1 to G8 are connected to the controller 52, and measurement values of the flow rate of the pressurized fluid flowing through each of the fluid delivery lines F1 to F8 are sent from the flow meters G1 to G8 to the controller 52.

The controller 52 is configured to detect a leak of fluid from the elastic membrane assembly 7 based on a change in the measurement values of the pressure of the pressurized fluid, and a change in the measurement values of the flow rate of the pressurized fluid. The leak checking is performed sequentially for each of the pressure chambers 12, 14*a*, 14*b*, and 16*a* to 16*e*. One embodiment of the leak checking for the pressure chamber 12 will be described below. When performing the leak checking, the elastic membrane 10 is placed in close contact with the elastic membrane stage 54*b* of the stage 54. In order to bring the elastic membrane 10 in close contact with the elastic membrane stage 54*b* of the stage 54, the coupling head 55 may be lowered by use of a vertical movement mechanism, which is not shown in the drawings.

Figure 14:
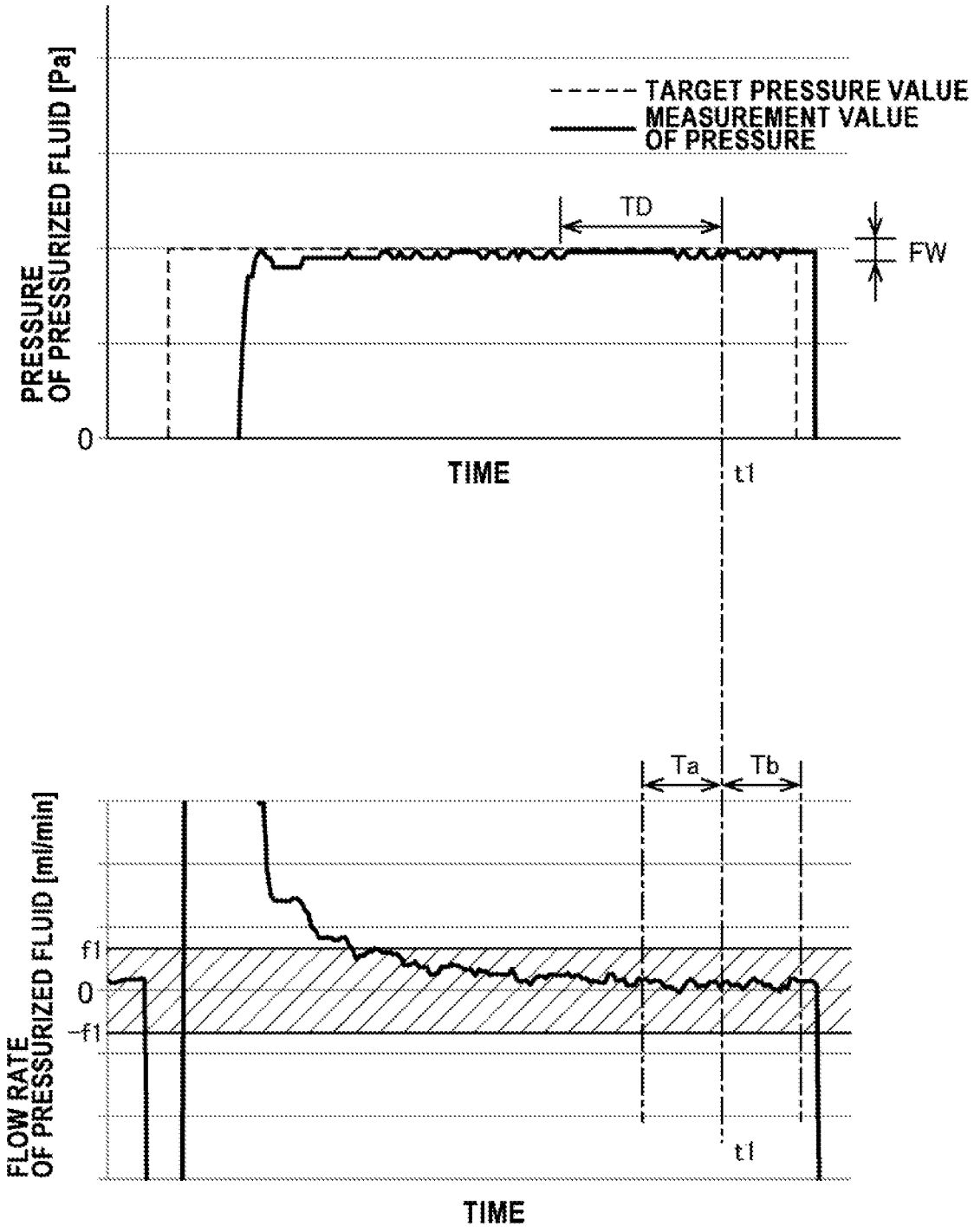
FIG. 14 is a graph showing an example of a change in pressure of the pressurized fluid in the pressure chamber, and a change in flow rate of the pressurized fluid flowing in a fluid delivery line communicating with the pressure chamber, when there is no leakage of the pressurized fluid.
Figure 15:
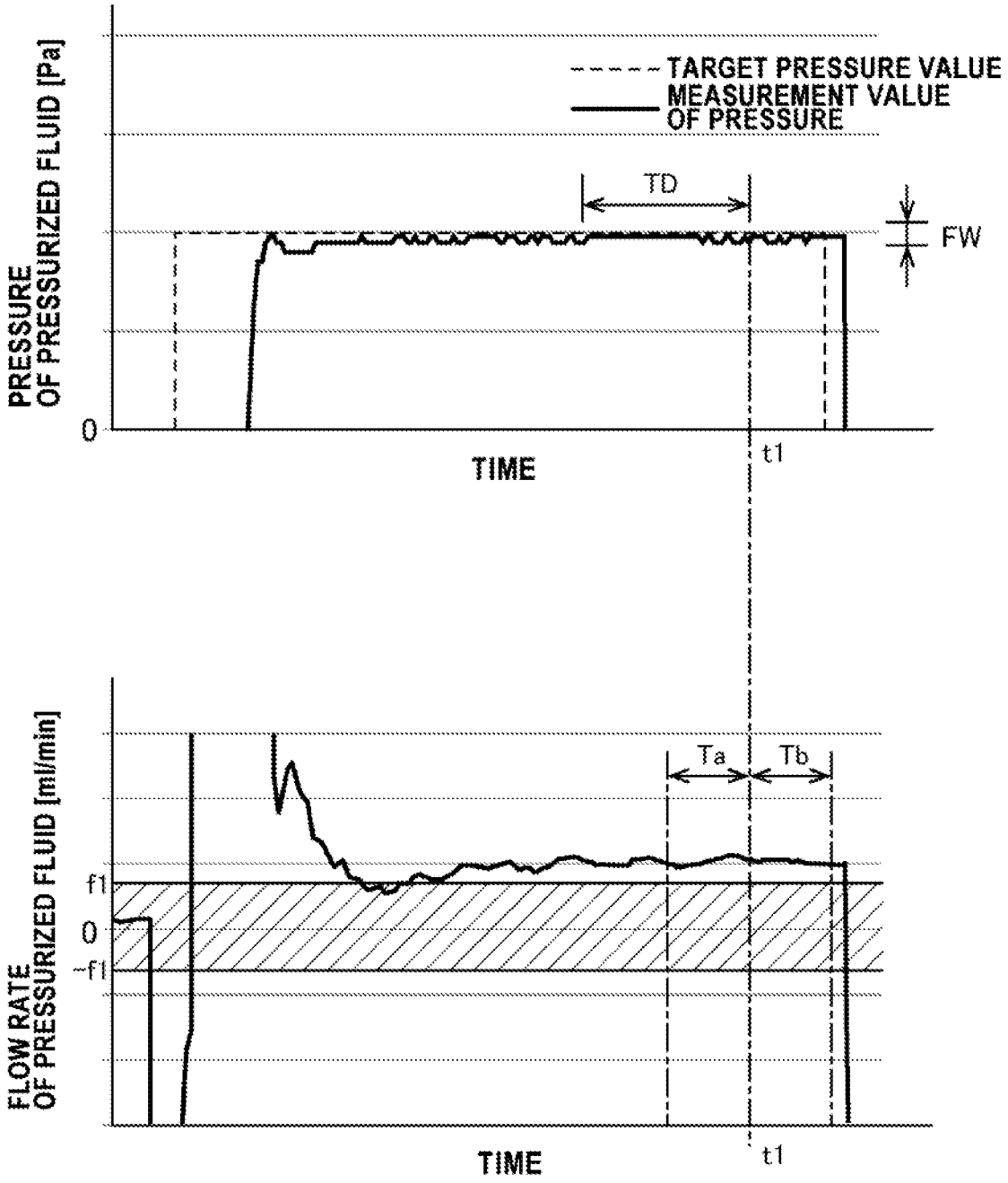
FIG. 15 is a graph showing an example of a change in pressure of the pressurized fluid in the pressure chamber, and a change in flow rate of the pressurized fluid flowing in a fluid delivery line communicating with the pressure chamber, when there is leakage of the pressurized fluid.

FIG. 14 is a graph showing an example of the change in the pressure of the pressurized fluid in the pressure chamber 12, and the change in the flow rate of the pressurized fluid flowing in the fluid delivery line F1 communicating with the pressure chamber 12, when there is no leakage of the pressurized fluid. FIG. 15 is a graph showing an example of the change in the pressure of the pressurized fluid in the pressure chamber 12, and the change in the flow rate of the pressurized fluid flowing in the fluid delivery line F1 communicating with the pressure chamber 12, when there is leakage of the pressurized fluid. The pressurized fluid is supplied into the pressure chamber 12 through the fluid delivery line F1. The pressure regulator R1 is operated to maintain the pressure of the pressurized fluid in the pressure chamber 12 at a preset target pressure value. The pressure of the pressurized fluid in the pressure chamber 12 is measured by the pressure sensor P1, and the flow rate of the pressurized fluid flowing in the fluid delivery line F1 is measured by the flow meter G1. The measurement values of the pressure and the flow rate of the pressurized fluid are sent to the controller 52.

As shown in FIG. 14, although pressure hunting occurs in an initial stage when pressurized fluid begins to be supplied into the pressure chamber 12, the pressure of the pressurized fluid gradually becomes stable with the elapse of time. As the pressure becomes stable, the flow rate of the pressurized fluid is gradually lowered, and the flow rate eventually becomes almost zero. However, when a leak of the pressurized fluid occurs, as shown in FIG. 15, the flow rate of the pressurized fluid does not approach zero, even though the pressure of the pressurized fluid is stable. Specifically, as long as there is leakage of the pressurized fluid, the flow rate does not reach zero because the pressurized fluid having a flow rate corresponding to an amount of leakage continues to flow in the fluid delivery line F1.

Accordingly, in this embodiment, the leak checking is performed based on the pressure and the flow rate of the pressurized fluid. Specifically, flow meter G1 measures the flow rate of the pressurized fluid while the pressurized fluid is supplied into the pressure chamber 12 through the pressure regulator R1, and the pressure sensor P1 measures the pressure of the pressurized fluid in the pressure chamber 12. The controller 52 is configured to determine whether or not the flow rate of the pressurized fluid measured when the pressure of the pressurized fluid is stable, is within a preset reference range (±f1). The controller 52 is configured to generate a leak-detection signal when the flow rate is outside the reference range.

The controller 52 stores in advance the allowable range of variation for determining whether or not the pressure of the pressurized fluid is stable. The symbol FW shown in FIGS. 14 and 15 represents the allowable range of variation. In one embodiment, a center of the allowable range of variation FW coincides with the target pressure value. The controller 52 is configured to detect the leakage of the pressurized fluid based on the flow rate measured when the variation in the pressure of the pressurized fluid is within the allowable range of variation FW, i.e., when the pressure of the pressurized fluid is stable.

The controller 52 determines a time point t1 when the variation in the pressure of the pressurized fluid is within the allowable range of variation FW, and determines whether or not the flow rate of the pressurized fluid (i.e., the measurement value of the flow meter G1) during a predetermined time interval measured from the time point t1 is within the preset reference range (±f1). In one embodiment, the controller 52 may measure an elapsed time when the variation in the pressure of the pressurized fluid is within the allowable range of variation FW to determine a time point at which the elapsed time exceeds a set time, as the time point t1.

In an example shown in FIGS. 14 and 15, the time point t1 is a time point at which the elapsed time when the variation in the pressure of the pressurized fluid is within the allowable range of variation FW exceeds a set time TD. Specifically, the controller 52 stores in advance the mentioned set time TD, and measures an elapsed time when the variation in the pressure of the pressurized fluid is being within the allowable range of variation FW, from a moment at which the pressure of pressurized fluid falls within the allowable range of variation FW. If the elapsed time when the variation in the pressure of the pressurized fluid is within the allowable range of variation FW exceeds the set time ID, the controller 52 determines a time point at which the elapsed time has just exceeded the set time TD, as the time point t1. If before the elapsed time reaches the set time ID, the variation in the pressure of the pressurized fluid deviates from the allowable range of variation FW, the controller 52 interrupts the measurement of the elapsed time. When the variation in the pressure of the pressurized fluid falls again within the allowable range of variation FW, the controller 52 starts the measurement of the elapsed time.

Although not shown in the drawings, the controller 52 may store in advance a maximum monitoring time to monitor the variation in the pressure of the pressurized fluid. In this case, the controller 52 measures a gas-supply time for supplying the pressurized fluid into the pressure chamber 12. If the gas-supply time readies the maximum monitoring time while the elapsed time when the variation in the pressure of the pressurized fluid is within the allowable range of variation FW does not reach the set time ID, the controller 52 determines a time point that has just reached the maximum monitoring time, as the time point t1.

In this manner, in the example shown in FIGS. 14 and 15, the controller 52 determines the time point t1 when the variation in the pressure of the pressurized fluid is within the allowable range of variation FW. Furthermore, the controller 52 is configured to determine whether or not the flow rate of the pressurized fluid, which has been measured before reaching this time point t1 and measured in a predetermined time interval Ta, is within the reference range. In this embodiment, the time interval Ta is shorter than the set time TD described above. However, the time interval Ta may be equal to the set time TD. According to this embodiment, the flow rate measured before reaching time point t1 is used for the leak checking. Therefore, immediately after reaching the time point t1, the controller 52 can determine whether or not to generate the leak-detection signal (i.e., the leak of the pressurized fluid occurs or not), based on the measurement values of the flow rate that has been already obtained from the flow meter G1.

In one embodiment, the controller 52 may be configured to determine the time point t1 when the variation in the pressure of the pressurized fluid is within the allowable range of variation FW, and determine whether or not the flow rate of the pressurized fluid, which is measured after reaching the time point t1 and measured in a predetermined time interval Tb, is within the reference range. In the example shown in FIGS. 14 and 15, the time interval Tb is shorter than the set time TD described above. However, the time interval Tb may be equal to the set time TD.

Figure 16:
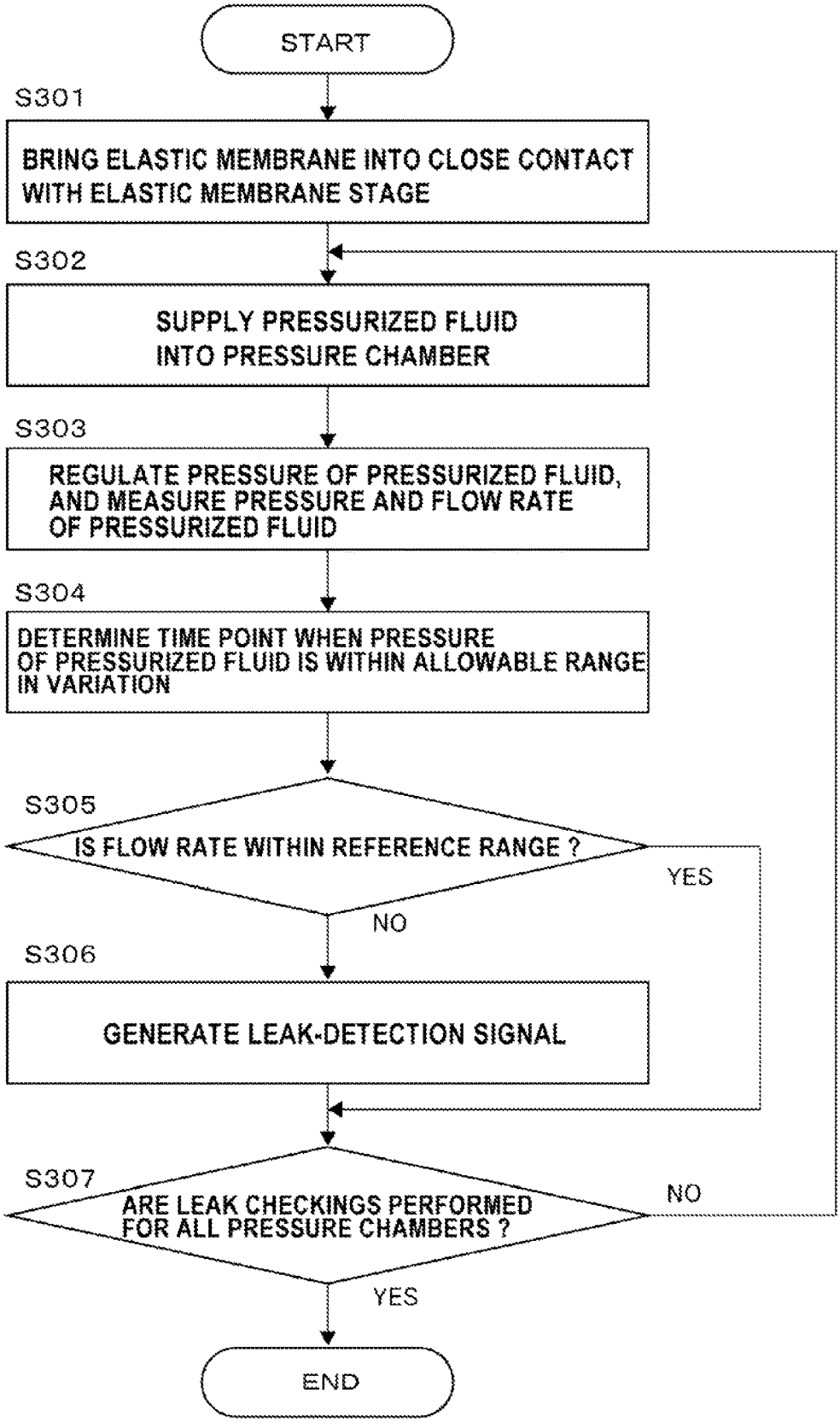
FIG. 16 is a flowchart showing a leak checking method according to one embodiment.

Next, one embodiment of the leak checking method is described with reference to a flowchart shown in FIG. 16. FIG. 16 is a flowchart showing the leak checking method according to one embodiment. In S301, the elastic membrane 10 is brought into close contact with the elastic membrane stage 54*b*. The purpose of bringing the elastic membrane 10 into close contact with the elastic membrane stage 54*b* is to stabilize the volume of the pressure chamber filled with the pressurized fluid. In S302, the controller 52 causes the open/close valve V1 to be opened, and the open/close valves V2 to V8 to be closed to thereby start the supply of the pressurized fluid into the pressure chamber 12 through the fluid delivery line F1.

In S303, while the pressurized fluid is supplied through the fluid delivery line F1 into the pressure chamber 12, the flow meter G1 measures the flow rate of the pressurized fluid flowing in the fluid delivery line F1, and the pressure regulator R1 regulates the pressure of the pressurized fluid so as to maintain the pressure of the pressurized fluid in the pressure chamber 12 to the target pressure value. The measurement values of flow rate are sent to the controller 52, and stored in a memory of the controller 52. While the pressurized fluid is being supplied into the pressure chamber 12, the pressure sensor P1 measures the pressure of the pressurized fluid in the fluid delivery line F1 (i.e., the pressure in the pressure chamber 12). The measurement values of pressure are sent to the controller 52, and stored in the memory of the controller 52. While the pressurized fluid is being supplied into the pressure chamber 12, the controller 52 monitors the measurement values of flow rate and the measurement values of pressure.

In S304, the controller 52 determines the time point t1 when the variation in the pressure of the pressurized fluid is within the allowable range of variation FW (i.e., the time point when the pressure of the pressurized fluid in the pressure chamber 12 is stable). In S305, the controller 52 determines whether or not the flow rate measured before reaching the determined time point t1 and measured in the predetermined time interval Ta is within the reference range (±f1). Alternatively, the controller 52 may determine whether or not the flow rate measured after reaching the determined time point t1 and measured in the predetermined time interval Tb is within the reference range. When the flow rate is outside the reference range, the controller 52 generates a leak-detection signal (S306). The leak-detection signal may be a trigger signal to issue an alarm. For example, the leak-detection signal may be an electrical signal to indicate a leak detection on the display 56 (see FIG. 4), or to activate an alarm device.

After the leak-detection signal is generated, or when the flow rate is within the reference range, the controller 52 performs S307. In S307, the controller 52 determines whether or not the leak checkings are performed for all the pressure chambers 12, 14*a*, 14*b*, 16*a* to 16*e*. The controller 52 repeats the operations of S302 to S306 until the leak checkings have been performed for all the pressure chambers 12, 14*a*, 14*b*, 16*a* to 16*e*. For example, in the case where the leak checking is performed for the pressure chamber 16*a*, the controller 52 causes the open/close valve V2 to be opened, and the open/close valves V1, V3 to V8 to be closed. The operations of S303 to S306 are performed in the same manner.

According to this embodiment, the pressure sensors P1 to P8 and the flow meters G1 to G8 provided in the fluid supply unit 60 can be used to perform the leak checking of the pressurized fluid supplied to the elastic membrane assembly 7. Therefore, the leak checking can be performed automatically before the elastic membrane assembly 7 is installed in the polishing apparatus. As a result, the burden on an operator to perform the leak checking can be reduced, and further, the reduction in the utilization rate of the polishing apparatus can be prevented.

In one embodiment, the pressure sensors P1 to P8 or the flow meters G1 to G8 may be used to perform the leak checking of the pressurized fluid supplied to the elastic membrane assembly 7. For example, in the case where the leak checking of the pressurized fluid is performed using the pressure sensors P1 to P8, the controller 52 causes the pressurized fluid having a predetermined pressure to be supplied into the pressure chamber 12, and then the open/close valve V1 to be closed. In the case where the leak checking of the pressurized fluid is performed using the flow meters G1 to G8, the controller 52 causes the pressurized fluid having a predetermined pressure into the pressure chamber 12, and the open/close valve V1 to be maintained in open state. The controller 52 measures (monitors) the pressure of the pressurized fluid or the flow rate of the pressurized fluid, and maintains this state until a predetermined checking time elapses. When performing the leak checking of the pressurized fluid using the flow meters G1 to G8, the measurement of flow rate may be started after a predetermined time elapses from starting of the supply of the pressurized fluid into the pressure chamber 12.

Next, the controller 52 determines whether or not to generate the leak signal based on the measurement values of the pressure of the pressurized fluid, or the measurement values of the flow rate of the pressurized fluid. More specifically, in the case where the leak checking of the pressurized fluid is performed using the pressure sensors P1 to P8, the controller 52 generates the leak signal when the variation width of the measurers values of the pressurized fluid is greater than or equal to a reference value. In the case where the leak checking of the pressurized fluid is performed using flow meters G1 to G8, the controller 52 compares the measurement values of the flow rate of the pressurized fluid with a reference range (e.g., ±f described with reference to FIG. 16). The controller 52 generates the leak signal when the measurement values of the flow rate of the pressurized fluid are outside the reference range. The controller 52 stores in advance the reference value set for the variation width of the measurement values of the pressure of the pressurized fluid, or the reference range set for the measurement values of the flow rate of the pressurized fluid.

When the leak is occurring in the elastic membrane 10, the measurement value of the pressure sensor P1 gradually decreases. Therefore, when the variation width of the measurement values of the pressure sensor P1 is greater than or equal to the reference value, the controller 52 determines that the leak is occurring in the elastic membrane 10, and generates the leak signal. Further, when the leak is occurring in the elastic membrane 10, the flow meter G1 detects the flow rate of the pressurized fluid. Therefore, when the measurement values of the flow meter G1 is outside the reference range, the controller 52 determines that the leak is occurring in the elastic membrane 10, and generates the leak signal. The controller 52 repeats the same leak checking until the leak checkings have been performed for all the pressure chambers 12, 14*a*, 14*b*, 16*a* to 16*e*.

Such leak checkings are preferably performed before performing the break-in operation described above. More specifically, the leak checkings are preferably performed between S101 and S102 shown in FIG. 7.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A break-in processing apparatus comprising:

a stage to which an elastic membrane assembly including at least a carrier and an elastic membrane attached to the carrier is placed;

a break-in determination module facing an outermost periphery portion of the elastic membrane of the elastic membrane assembly placed to the stage;

a fluid supply unit configured to supply a pressurized fluid having a predetermined pressure into a pressure chamber formed between the outermost periphery portion of the elastic membrane and the carrier; and a controller configured to control operations of the break-in determination module and the fluid supply unit, wherein the controller is configured to determine a completion of a break-in process of the elastic membrane based on a load applied to the break-in determination module by the elastic membrane which is expanded by the pressurized fluid supplied into the pressure chamber, wherein the break-in determination module includes:

a load distributing ring facing the outermost periphery portion of the elastic membrane; and a load cell configured to measure the load applied from the elastic membrane through the load distributing ring, and wherein the controller is further configured to:

compare a measurement result of the load cell to a reference value set in advance;

determine that the elastic membrane has acquired sufficient elasticity and completes the break-in process for the elastic membrane, when the measurement result of the load cell is equal to or greater than the reference value; and determine that an elasticity of the elastic membrane is insufficient, and repeats the break-in operation, when the measurement result of the load cell is lower than the reference value.

2. The break-in processing apparatus according to claim 1, wherein the break-in determination module further includes a shape measuring device which can measure a shape of a lower surface of the outermost periphery portion of the elastic membrane opened to atmosphere, and the controller confirms the completion of the break-in process of the elastic membrane based not only on the load applied to the break-in determination module, but also on the shape of the lower surface of the outermost periphery portion of the elastic membrane measured by the shape measuring device.

3. The break-in processing apparatus according to claim 2, wherein the shape measuring device is a two-dimensional displacement sensor that emits a laser beam to the lower surface of the outermost periphery portion of the elastic membrane to thereby obtain the shape of the lower surface of the outermost periphery portion of the elastic membrane.

4. The break-in processing apparatus according to claim 1, wherein the fluid supply unit includes:

a fluid supply line communicating with the pressure chamber; and a flow meter and/or a pressure gauge disposed in the fluid supply line, and wherein the controller supplies the pressurized fluid having a predetermined pressure into the pressure chamber;

measures a flow rate and/or a pressure of the pressurized fluid; and determines whether or not to generate a leak-detection signal based on measurement values of the flow rate and/or the pressure of the pressurized fluid.

5. The break-in processing apparatus according to claim 4, wherein the controller measures, during supplying of the pressurized fluid into the pressure chamber, the flow rate of the pressurized fluid while regulating the pressure of the pressurized fluid in the pressure chamber by use of a pressure regulator;

measures the pressure of the pressurized fluid in the pressure chamber;

determines whether or not measurement value of the flow rate of the pressurized fluid, which has been measured when variation of the pressure of the pressurized fluid is within an allowable range, is within a reference range; and generates the leak-detection signal when the flow rate is outside of the reference range.

6. A break-in processing method for an elastic membrane attached to a carrier, comprising:

placing an elastic membrane assembly including at least the carrier and the elastic membrane;

supplying a pressurized fluid having a predetermined pressure into a pressure chamber formed between an outermost periphery portion of the elastic membrane and the carrier; and determining a completion of a break-in process of the elastic membrane based on a load applied to a break-in determination module which faces the outermost periphery portion of the elastic membrane of the elastic membrane assembly placed to a stage to which the elastic membrane assembly is placed, wherein the determining the completion of the break-in process of the elastic membrane is determined based on a measurement result of a load cell which measures the load applied from the elastic membrane through a load distribution ring facing the outermost periphery portion of the elastic membrane, and wherein in the determining the completion of the break-in process of the elastic membrane, the measurement result of the load cell is compared to a reference value set in advance;

determining that the elastic membrane has acquired sufficient elasticity and completing the break-in process for the elastic membrane, when the measurement result of the load cell is equal to or greater than the reference value, and determining that an elasticity of the elastic membrane is insufficient, and repeating the break-in operation, when the measurement result of the load cell is lower than the reference value.

7. The break-in processing method according to claim 6, further comprising:

opening the pressure chamber to atmosphere;

measuring a shape of a lower surface of the outermost periphery portion of the elastic membrane; and confirming the completion of the break-in process of the elastic membrane based on the shape of the lower surface of the outermost periphery portion of the elastic membrane.

8. The break-in processing method according to claim 7, wherein measuring the shape of the lower surface of the outermost periphery portion of the elastic membrane is performed by use of a two-dimensional displacement sensor which emits a laser beam to the lower surface of the outermost periphery portion of the elastic membrane to thereby obtain the shape of the lower surface of the outermost periphery portion of the elastic membrane.

9. The break-in processing method according to claim 6, further comprising:

performing a leak checking of the elastic membrane before the break-in process, wherein the leak checking includes:

supplying a pressurized fluid into the pressure chamber in a state where the elastic membrane is placed in close contact with the stage;

measuring a flow rate and/or a pressure of the pressurized fluid; and determining whether or not to generate a leak-detection signal based on the flow rate and/or the pressure of the pressurized fluid.

10. The break-in processing method according to claim 9, wherein the leak checking includes:

measuring, during supplying of the pressurized fluid into the pressure chamber, the flow rate of the pressurized fluid while regulating the pressure of the pressurized fluid in the pressure chamber by use of a pressure regulator;

measuring the pressure of the pressurized fluid in the pressure chamber;

determining whether or not measurement value of the flow rate of the pressurized fluid, which has been measured when variation of the pressure of the pressurized fluid is within an allowable range, is within a reference range; and generating the leak-detection signal when the flow rate is outside of the reference range.

* * * * *